US005573899A

United States Patent [19]

Kase

[11] Patent Number: 5,573,899

[45] Date of Patent: Nov. 12, 1996

[54] SILVER HALIDE PHOTOGRAPHIC MATERIAL

[75] Inventor: Akira Kase, Kanagawa, Japan

[73] Assignee: Fuji Photo Film Co., Ltd., Kanagawa, Japan

[21] Appl. No.: 245,071

[22] Filed: May 17, 1994

Related U.S. Application Data

[63] Continuation of Ser. No. 974,479, Nov. 12, 1992, abandoned.

[30] Foreign Application Priority Data

Nov. 15, 1991 [JP] Japan ..... 3-326685

[51] Int. Cl.[6] ..... G03C 1/83; G03C 1/825; G03C 1/09; G03C 1/34

[52] U.S. Cl. ..... 430/517; 430/510; 430/567; 430/603; 430/601; 430/600; 430/611

[58] Field of Search ..... 430/512, 567, 430/600, 601, 603, 610, 611, 614, 510, 517

[56] References Cited

U.S. PATENT DOCUMENTS

| | | | |
|---|---|---|---|
| 1,574,944 | 3/1926 | Sheppard | 430/603 |
| 1,602,591 | 10/1926 | Sheppard | 430/603 |
| 3,772,031 | 11/1973 | Berry et al. | 96/108 |
| 4,865,962 | 9/1989 | Hasebe et al. | 430/567 |
| 4,912,026 | 3/1990 | Miyoshi et al. | 430/611 |
| 4,944,362 | 2/1991 | Okumura et al. | 430/611 |
| 5,057,402 | 10/1991 | Shiba et al. | 430/567 |
| 5,176,993 | 1/1993 | Ohshima | 430/611 |
| 5,180,659 | 1/1993 | Murai et al. | 430/611 |
| 5,215,880 | 6/1993 | Kojima et al. | 430/601 |
| 5,273,874 | 12/1993 | Kojima et al. | 430/600 |

FOREIGN PATENT DOCUMENTS

| | | | |
|---|---|---|---|
| 800958 | 12/1968 | Canada | 430/603 |
| 1295462 | 11/1972 | United Kingdom . | |
| 1396698 | 6/1975 | United Kingdom . | |

*Primary Examiner*—Richard L. Schilling
*Attorney, Agent, or Firm*—Sughrue, Mion, Zinn, Macpeak & Seas

[57] ABSTRACT

A silver halide photographic material having at least one light-sensitive emulsion layer containing a silver halide emulsion on a support, in which at least one silver halide emulsion layer contains silver halide grains of silver chloride or silver chlorobromide having a silver chloride content of 90 mol % or more, the silver halide grains being tellurium-sensitized, and at least one of light-sensitive emulsion layers or non-light-sensitive emulsion layers on the support contains at least one specific compound represented by formula (I), (II) or (III) herein. The material has excellent rapid processability and a high sensitivity. It involves little photographic fluctuation before and after continuous processing thereof and little photographic fluctuation due to variation of the ambient humidity during exposure thereof. The image sharpness of the material may be noticeably improved without appreciably detracting from the sensitivity thereof.

10 Claims, No Drawings

SILVER HALIDE PHOTOGRAPHIC MATERIAL

This is a Continuation of application Ser. No. 07/974,479 filed Nov. 12, 1992 now abandoned.

FIELD OF THE INVENTION

The present invention relates to a silver halide photographic material which, more precisely, has excellent rapid processability, high sensitivity, the photographic properties of which hardly fluctuate before and after continuous processing and hardly fluctuate even under variation of the ambient moisture condition during exposure, and which may form an image having excellent image sharpness.

BACKGROUND OF THE INVENTION

Various kinds of silver halide photographic materials are now sold in the commercial market and various methods for processing them are known. They are utilized in various technical fields. Of such photographic materials, those for color photographic paper products which are used in the market where a large amount of color prints are needed to be finished within a short time of delivery to consumers contain silver bromide or silver chlorobromide and which do not substantially contain silver iodide.

Recently, improvement of the rapid processability of color photographic papers is increasingly requested, and many studies thereon have been made. It is known that elevation of the silver chloride content in a silver halide emulsion to be used for preparing a color photographic paper brings about a drastic improvement or acceleration of the developability of the paper. In fact, in the market, use of a high silver chloride emulsion in preparing commercial color photographic papers has been promoted.

On the other hand, for processing color photographic papers, not only the rapid processability but also the processing stability is required. Namely, where a large amount of color prints are continuously processed, a small fluctuation of the photographic properties of the processed prints is desired before and after continuous processing. Recently, in particular, reduction of the amount of the replenisher to be added during processing of photographic materials is desired for the purpose of saving natural resources and of reducing environmental pollution. Also, from the point of new of, provision of photographic materials for color printing papers, photographic properties which hardly fluctuate before and after continuous processing is important. JP-A-1-167752 has disclosed a technique of reducing fluctuation of the photographic properties of photographic materials before and after continuous processing, by incorporating auxiliary silver halide grains which are not substantially developed in a non-light-sensitive layer. (The term "JP-A" as used herein means an "unexamined Japanese patent application".) In accordance with the disclosed technique, however, the improving effect is not always sufficient.

In addition, color photographic papers are also needed to be able to form images of high image sharpness. In particular, use of printing computer graphic images, line images or letter images in color photographic papers, in addition to the ordinary use of printing ordinary color images, such as portraits or landscapes is increasing. Therefore, the demand for obtaining images with high image sharpness in color photographic papers is ever-increasing. It is well known that the image sharpness of images to be formed in color photographic materials may well be elevated by inhibiting irradiation or halation by incorporating dyes or colloidal silver into the materials. However, incorporation of them is known to involve a depression in the sensitivity of the materials. In order to prevent this drawback, high-sensitivity silver halide emulsions must be used for preparing the materials. Heretofore, silver halide emulsions having a high silver chloride content which are suitable for rapid processing could hardly produce high-sensitivity photographic materials. In order to improve the high-sensitivity photographic materials using silver halide emulsions having a high silver chloride content, various techniques have heretofore been proposed and disclosed.

Examples include JP-A-58-85736, JP-A-58-108533, JP-A-60-222844, JP-A-60-222845 and JP-A-64-26837 which illustrate and demonstrate that photographic materials containing high silver chloride emulsions which have a silver bromide rich-region of various constitution and which have been sulfur-sensitized have high sensitivity and hard photographic property. In accordance with the illustrated techniques, high-sensitivity emulsions could be obtained, however, the photographic materials containing such high-sensitivity emulsions disadvantageously involve a noticeable fluctuation in the photographic properties before and after continuous processing thereof.

The present inventors investigated the above-mentioned problems and, as a result, found that tellurium-sensitized high silver chloride emulsions may form high sensitivity silver halide photographic materials having excellent continuous processability. Tellurium sensitization kind of chalcogen sensitization. However, such tellurium sensitization is not widely known, though sulfur sensitization and selenium sensitization have heretofore been investigated in detail in this technical field. For instance, a tellurium sensitization method and tellurium sensitizing agent are generally disclosed in U.S. Pat. Nos. 1,623,499, 3,320,069, 3,772,031, 3,531,289, 3,655,394, 4,704,349; British Patents 235,211, 1,121,496, 1,295,462, 1,396,696, 2,160,993; Canadian Patent 800,958; and JP-A-61-67845. However, detailed and concrete descriptions relating to tellurium sensitization are only in British Patents 1,295,462 and 1,396,696, and Canadian Patent 800,958. Thus, the technology of application of tellurium sensitization of a silver halide emulsion having a high silver chloride content to yield a silver halide photographic material having a high sensitivity and excellent continuous processability, as in the present invention, is not known at all.

When a tellurium-sensitized high silver chloride emulsion was used in forming a photographic material and the material was tested for practical use, it has been found for the first time that the material involves a serious drawback with respect to the exposure humidity dependence. Namely, it has been determined that when the ambient humidity during exposure of the photographic material is high, then the depression in the image density with respect to the image to be formed in the material is large.

SUMMARY OF THE INVENTION

Accordingly, an object of the present invention is to overcome the above-mentioned problems in the art and, specifically, to provide a silver halide photographic material which has excellent rapid processability, high sensitivity, the photographic properties of which hardly fluctuate before and after continuous processing and hardly fluctuate even under variation of the ambient moisture condition during exposure, and which may form an image having excellent image sharpness.

These and other objects of the present invention are effectively attained by a silver halide photographic material having at least one light-sensitive emulsion layer containing a silver halide emulsion on a support, in which at least one silver halide emulsion layer contains silver halide grains of silver chloride or silver chlorobromide having a silver chloride content of 90 mol % or more, the silver halide grains being tellurium-sensitized, and at least one of the light-sensitive emulsion layers or non-light-sensitive emulsion layers on the support contain at least one compound represented by general formulae (I), (II) or (III):

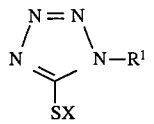
(I)

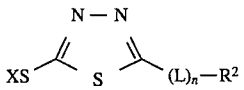
(II)

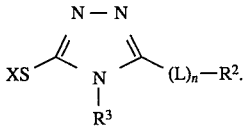
(III)

In formula (I), $R^1$ represents an alkyl group, an alkenyl group or an aryl group; and X represents a hydrogen atom, an alkali metal, an ammonium group or a precursor.

In formula (II), L represents a divalent linking group; $R^2$ represents a hydrogen atom, an alkyl group, an alkenyl group or an aryl group; X has the same meaning as that in formula (I); and n represents 0 or 1.

In formula (III), X has the same meaning as that in formula (I); L, $R^2$ and n each have the same meaning as in formula (II); $R^3$ has the same meaning as $R^2$ and may be the same or different from $R^2$.

As one preferred embodiment of the invention, the support is a reflective support, and an anti-halation layer is provided between the reflective support and the light-sensitive emulsion layer.

DETAILED DESCRIPTION OF THE INVENTION

The present invention will be explained in detail hereunder.

The silver halide emulsion for use in the present invention comprises "silver chloride or silver chlorobromide having a silver chloride content of 90 mol % or more", which means that the mean halogen composition of the silver halide grains to be in the emulsion is silver chloride or silver chlorobromide comprising silver chloride of 90 mol % or more and substantially not containing silver iodide. The wording "substantially not containing silver iodide" as referred to herein means that the silver iodide content in the emulsion is preferably 1.0 mol % or less. As a mean halogen composition of the silver halide grains in the emulsion, preferred is substantially silver iodide-free silver chloride or silver chlorobromide having a silver chloride content of 95 mol % or more. A substantially silver iodide-free silver chloride or silver chlorobromide having a silver chloride content of 99 mol % or more is most preferable.

It is desired for he silver halide grains of the present invention to have a layer-like or non-layer-like local phase having a silver bromide content of at least 10 mol % or more in the inside and/or surface of the grain. Such a local phase having a high silver bromide content is desired to be near the surface of the grain in view of the continuous processability and the pressure resistance of the grains. The place near the surface of the silver halide grain, as referred to herein, is within ⅕ of the grain size of the grain from the outermost surface thereof. More preferably, it is within 1/10 of the grain size of the grain from the outermost surface thereof. The most preferred disposition of the local phase having a high silver bromide content is such that a local phase having a silver bromide content of at least 10 mol % or more has grown by epitaxial growth on the corners of a cubic or tetradecahedral silver chloride grain.

The silver bromide content of the local phase having a high silver bromide content is preferably 10 mol % or more. However, if the silver bromide content therein is too high, the photographic material would be desensitized when a pressure is imparted thereto or the sensitivity or gradation of the material would largely vary before and after continuous processing of the material. In any event, such a high silver bromide content in the local phase would often impart some unfavorable characteristics to the photographic material. Consequently, the silver bromide content of the local phase having a high silver bromide content is desired to be from 10 to 60 mol %, more preferably from 20 to 50 mol %. The silver bromide content of the local phase having a high silver bromide content may be analyzed, for example, by an X-ray diffraction method (for example, as described in New Experimental Chemistry, Lecture 6, Analysis of Structure, edited by Japan Chemical Society and published by Maruzen Co.). The local phase having a high silver bromide content is desirably composed of from 0.1 to 20 mol % of silver, more preferably, from 0.2 to 5 mol % of silver, to the total silver amount constituting the silver halide grains of the present invention.

The interface between the local phase having a high silver bromide and other phase may have a clear phase boundary or may have a transition range where the halogen composition gradually varies.

For forming the local phase having a high silver bromide content, various methods may be employed. For instance, a soluble silver salt and soluble halogen salt(s) are reacted by a single jet method or a double jet method to form the intended local phase. Apart from this, a so-called conversion method may also be employed, in which silver halide grains already formed are converted into others having a lower solubility product to form the intended local phase on each grain. In addition, another method may also preferably be employed in which cubic or tetradecahedral silver halide host grains are blended with other fine silver halide grains having a smaller mean grain size than the host grains and having a higher silver bromide content than the same, and then the blend is ripened to form the intended local phase having a high silver bromide content on each host grain.

The mean grain size of the silver halide grains to be contained in the silver halide emulsion for use in the present invention is preferably from 0.1 μm to 2 μm. (The grain size of each grain is represented by the diameter of a circle equivalent to the projected area of the grain, and the mean grain size is represented by the number average of the grain sizes of all the grains.)

The fluctuation coefficient of the grain size distribution of the grains (which is obtained by dividing the standard deviation of the grain size distribution by the mean grain size) is desired to be 20 % or less, more preferably, 15 % or less. That is, a so-called monodispersed emulsion is preferred. In order to obtain a broader latitude, a blend of different mono-dispersed emulsions is preferably incorporated into one and the same layer, or such different mono-dispersed emulsions may be incorporated into plural layers to be overlaid on a support.

Regarding the shape of the silver halide grains to be in the photographic emulsions for use in the present invention, the grains may be regular crystalline ones such as cubic, tetradecahedral or octahedral, or may be irregular crystalline ones such as spherical or tabular, or may be composite crystalline ones comprising such regular and/or irregular crystalline shape(s). The emulsions may be composed of a mixture of grains of various crystalline shapes. In the present invention, preferred are emulsions containing 50 % by weight or more, preferably 70 % by weight or more, more preferably 90 % by weight or more, of the above-mentioned regular crystalline grains.

In addition to them, also preferred are emulsions containing 50 % by weight or more, as the projected area of the total grains, of tabular grains having a mean aspect ratio (circle-equivalent diameter/thickness) of 5 or more, preferably, 8 or more.

The silver chlorobromide emulsion for use in the present invention may be prepared by known methods, for example, by those described in P. Glafkides, *Chimie et Physique Photographique* (published by Paul Montel Co., 1967), G. F. Duffin, *Photographic Emulsion Chemistry* (published by Focal Press Co., 1966), and V. L. Zelikman et al, *Making and Coating Photographic Emulsion* (published by Focal Press Co., 1964). For instance, they may be prepared by any of an acid method, a neutral method or an ammonia method. As a system of reacting a soluble silver salt and soluble halogen salt(s), any of a single jet method, a double jet method and a combination thereof may be employed. A so-called reverse mixing method may also be employed in which silver halide grains are formed in an atmosphere having excess silver ions. As one system of a double jet method, a so-called controlled double jet method in which the pAg value in the liquid phase forming silver halide grains is kept constant may also be employed. In accordance with this method, silver halide grains each having a regular crystalline form and having a nearly uniform grain size can be obtained.

Into the silver halide emulsions for use in the present invention can be introduced various polyvalent metal ion impurities, during formation of the emulsion grains or during physical ripening of them. As examples of compounds usable for this purpose, salts of cadmium, zinc, lead, copper or thallium, as well as salts or complex salts of elements of the Group VIII of the Periodic Table, such as iron, ruthenium, rhodium, palladium, osmium, iridium or platinum are disclosed. In particular, preferred are the above-mentioned elements of Group VIII. The amount of these compounds to be added may vary over a broad range and is preferably from $10^{-9}$ to $10^{-2}$ mol, per mol of silver halide.

Next, tellurium sensitization to be applied to the silver halide emulsions of the present invention is explained in detail hereunder.

As the tellurium sensitizing agent to be used in the present invention, preferred are compounds described in U.S. Pat. Nos. 1,623,499, 3,320,069, 3,772,031; British Patents 235, 211, 1,121,496, 1,295,462, 1,396,696; Canadian Patent 800, 958; *J. Chem. Soc. Chem. Commun.*, 635 (1980), ibid., 1102 (1979), ibid., 645 (1979); and *J. Chem. Soc. Perkin Trans.*, 1, 2191 (1980).

As specific examples of the tellurium sensitizing agent for use in the present invention, there are mentioned colloidal tellurium, telluroureas (e.g., allyltellurourea, N,N-dimethyltellurourea, tetramethyltellurourea, N-carboxyethyl-N',N'-dimethyltellurourea, N,N'-dimethylethylenetellurourea, N,N'-diphenylethylenetellurourea), isotellurocyanates (e.g., allylisotellurocyanate), telluroketones (e.g., telluroacetone, telluroacetophenone), telluroamides (e.g., telluroacetamide, N,N-dimethyltellurobenzamide), tellurohydrazides (e.g., N,N',N'-trimethtyltellurobenzohydrazide), telluroesters (e.g., t-butyl-t-hexyltelluroester), phosphine tellurides (e.g., tributylphosphine telluride, tricyclohexylphosphine telluride, triisopropylphosphine telluride, butyldiisopropylphosphine telluride, dibutylphenylphosphine telluride), and other tellurium compounds such as negative-charged telluride ion-containing gelatins as described in British Patent 1,295,462, potassium telluride, potassium tellurocyanate, telluropentathionate sodium salt, allyltellurocyanate.

Of these tellurium compounds, preferred are those of the following general formulae (IV) and (V):

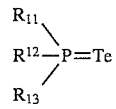

(IV)

where $R_{11}$, $R_{12}$, and $R_{13}$ independently represent an aliphatic group, an aromatic group, a heterocyclic group, $OR_{14}$, $NR_{15}(R_{16})$, $SR_{17}$, $OSiR_{18}(R_{19})$ $(R_{20})$, a halogen atom or a hydrogen atom;

$R_{14}$ and $R_{17}$ independently represent an aliphatic group, an aromatic group, a heterocyclic group, a hydrogen atom or a cation; $R_{15}$ and $R_{16}$ independently represent an aliphatic group, an aromatic group, a heterocyclic group or a hydrogen atom; $R_{18}$, $R_{19}$ and $R_{20}$ independently represent an aliphatic group.

Compounds of formula (IV) will be explained in more detail hereunder.

In formula (IV), the aliphatic group of $R_{11}$, $R_{12}$, $R_{13}$, $R_{14}$, $R_{15}$, $R_{16}$, $R_{17}$, $R_{18}$, $R_{19}$ or $R_{20}$ is one having from 1 to 30 carbon atoms, especially a linear, branched or cyclic alkyl, alkenyl, alkynyl or aralkyl group having from 1 to 20 carbon atoms. As the alkyl, alkenyl, alkynyl and aralkyl groups, there are mentioned, for example, methyl, ethyl, n-propyl, isopropyl, t-butyl, n-octyl, n-decyl, n-hexadecyl, cyclopentyl, cyclohexyl, allyl, 2-butenyl, 3-pentenyl, propargyl, 3-pentynyl, benzyl and phenethyl groups.

In formula (IV), the aromatic group of $R_{11}$, $R_{12}$, $R_{13}$, $R_{14}$, $R_{15}$, $R_{16}$ or $R_{17}$ is preferably one having from 6 to 30 carbon atoms, especially preferably a monocyclic or condensed cyclic aryl group having from 6 to 20 carbon atoms. This includes, for example, phenyl and naphthyl groups.

In formula (IV), the heterocyclic group of $R_{11}$, $R_{12}$, $R_{13}$, $R_{14}$, $R_{15}$, $R_{16}$ or $R_{17}$ is a 3-membered to 10-membered saturated or unsaturated heterocyclic group containing at least one hetero atom of nitrogen, oxygen and sulfur atoms. This may be a monocyclic one or may form a condensed ring with other aromatic ring(s) and/or heterocyclic ring(s). The heterocyclic group is preferably a 5- or 6-membered aromatic heterocyclic group, including, for example, pyridyl, furyl, thienyl, thiazolyl, imidazolyl and benzimidazolyl groups.

In formula (IV), the cation of $R_{14}$ or $R_{17}$ is, for example, an alkali metal cation or an ammonium cation.

In formula (IV), the halogen atom is, for example, a fluorine atom, chlorine atom, bromine atom or iodine atom.

The aliphatic group, aromatic group and heterocyclic group may optionally be substituted. As substituents for the groups, there are typically mentioned an alkyl group, an aralkyl group, an alkenyl group, an alkynyl group, an aryl group, an alkoxy group, an aryloxy group, an amino group, an acylamino group, a ureido group, a urethane group, a sulfonylamino group, a sulfamoyl group, a carbamoyl group, a sulfonyl group, a sulfinyl group, an alkyloxycarbonyl group, an aryloxycarbonyl group, an acyl group, an acyloxy group, a phosphoric acid amido group, a diacylamino group, an imido group, an alkylthio group, an arylthio group, a halogen atom, a cyano group, a sulfo group, a carboxyl group, a hydroxyl group, a phosphono group, a nitro group, and a heterocyclic group. These groups may further be substituted. If the group has two or more substituents, they may be the same or different from one another.

$R_{11}$, $R_{12}$ and $R_{13}$ may be bonded to each other to form a ring along with the phosphorus atom in the formula; and $R_{15}$ and $R_{16}$ may be bonded to each other to form a nitrogen-containing hetero ring.

The ring to be formed by $R_{11}$, $R_{12}$ and $R_{13}$ along with the phosphorus atom in the formula, as well as the nitrogen-containing hetero ring to be formed by $R_{15}$ and $R_{16}$ is preferably a 5- or 6-membered ring.

In formula (IV), $R_{11}$, $R_{12}$ and $R_{13}$ each are preferably an aliphatic group or an aromatic group, more preferably, an alkyl group or an aromatic group.

Formula (V) is represented by the following general formula:

$$R_{21}-\overset{\overset{\displaystyle Te}{\|}}{C}-R_{22} \qquad (V)$$

where $R^{21}$ represents an aliphatic group, an aromatic group, a heterocyclic group, or $-NR_{23}(R_{24})$; $R^{22}$ represents $-NR_{25}(R_{26})$, $-N(R_{27})N(R_{28})R_{29}$, or $-OR_{30}$; $R^{23}$, $R_{24}$, $R_{25}$, $R_{26}$, $R_{27}$, $R_{28}$, $R_{29}$ and $R_{30}$ each represent a hydrogen atom, an aliphatic group, an aromatic group, a heterocyclic group or an acyl group; and $R_{21}$ and $R_{25}$; $R_{21}$ and $R_{27}$; $R_{21}$ and $R_{28}$; $R_{21}$ and $R_{30}$; $R_{23}$ and $R_{25}$; $R_{23}$ and $R_{27}$; $R_{23}$ and $R_{28}$; and $R_{23}$ and $R_{30}$ each may be bonded to each other to form a ring.

Compounds of formula (V) will be explained in more detail.

In formula (V), the aliphatic group of $R_{21}$, $R_{23}$, $R_{24}$, $R_{25}$, $R_{26}$, $R_{27}$, $R_{28}$, $R_{29}$ or $R_{30}$ has the same meaning as that of $R_{11}$ to $R_{20}$ in formula (IV).

In formula (V), the aromatic group of $R_{21}$, $R_{23}$, $R_{24}$, $R_{25}$, $R_{26}$, $R_{27}$, $R_{28}$, $R_{29}$ or $R_{30}$ has the same meaning as that of $R_{11}$ to $R_{17}$ in formula (IV).

In formula (V), the heterocyclic group of $R_{21}$, $R_{23}$, $R_{24}$, $R_{25}$, $R_{26}$, $R_{27}$, $R_{28}$, $R_{29}$ or $R_{30}$ has the same meaning as that of $R_{11}$ to $R_{17}$ in formula (IV).

In formula (V), the acyl group of $R_{23}$, $R_{24}$, $R_{25}$, $R_{26}$, $R_{27}$, $R_{28}$, $R_{29}$ or $R_{30}$ is preferably one having from 1 to 30 carbon atoms, especially preferably a linear or branched acyl group having from 1 to 20 carbon atoms. It includes, for example, acetyl, benzoyl, formyl, pivaloyl and decanoyl groups.

Where $R_{21}$ and $R_{25}$; $R_{21}$ and $R_{27}$; $R_{21}$ and $R_{28}$; $R_{21}$ and $R_{30}$; $R_{23}$ and $R_{25}$; $R_{23}$ and $R_{27}$; $R_{23}$ and $R_{28}$; and $R_{23}$ and $R_{30}$ each form a ring, the atomic group necessary for forming the ring includes, for example, an alkylene group, an arylene group, an aralkylene group and an alkenylene group.

The aliphatic group, aromatic group and heterocyclic group may optionally be substituted by one or more substituents, such as those mentioned for formula (IV).

More preferably in formula (V), $R_{21}$ is an aromatic group or $-NR_{23}(R_{24})$; $R_{22}$ is $-NR_{25}(R_{26})$; and $R_{23}$, $R_{24}$, $R_{25}$ and $R_{26}$ each are an alkyl group or an aromatic group. Also more preferably, $R_{21}$ and $R_{25}$, and $R_{23}$ and $R_{25}$ each may form a ring via an alkylene group, an arylene group, an aralkylene group or an alkenylene group.

Examples of compounds of formulae (IV) and (V) for use in the present invention include, but are not limited to, the following compounds:

$(nC_4H_9)_3P{=}Te$ IV-1.

$(tC_4H_9)_3P{=}Te$ IV-2.

$(C_6H_{11})_3P{=}Te$ IV-3.

$((i)C_3H_7)_3P{=}Te$ IV-4.

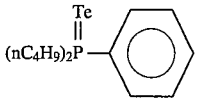
IV-5.

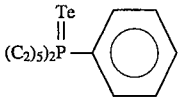
IV-6.

$((i)C_4H_9)_3P{=}Te$ IV-7.

$((i)C_4H_9)_2P(Te)C_4H_9(n)$ IV-8.

$(i)C_3H_7P(Te)(C_4H_9(n))_2$ IV-9.

$((i)C_3H_7)_2P(Te)(C_4H_9(n))$ IV-10.

$(i)C_3H_7P(Te)(C_4H_9(i))_2$ IV-11.

$((i)C_3H_7)_2P(Te)C_4H_9(i)$ IV-12.

$((i)C_3H_7)_2P(Te)C_8H_{17}(n)$ IV-13.

$C_2H_5P(Te)(OC_2H_5)_2$ IV-14.

$(n\text{-}C_4H_9O)_3P{=}Te$ IV-15.

$C_2H_5P(Te)-(N(CH_3)_2)_2$ IV-16.

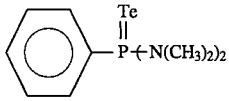
IV-17.

$((CH_3)_2N)_3P{=}Te$ IV-18.

$((CH_3)_2SiO)_2P(Te)H$ IV-19.

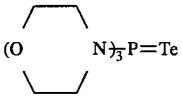
IV-20.

$(C_2H_5)_2P(Te)N(C_2H_5)_2$ IV-21.

-continued

IV-22.

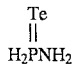

V-1.

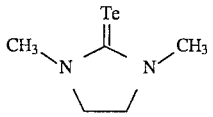

V-2.

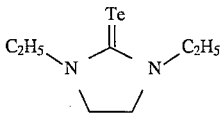

V-3.

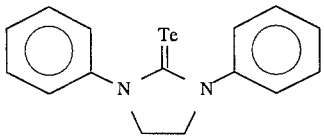

V-4.

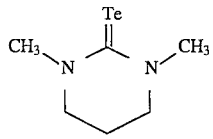

V-5.

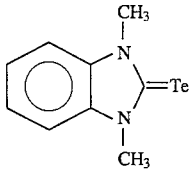

V-6.

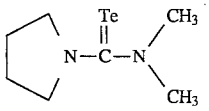

V-7.

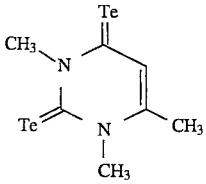

V-8.

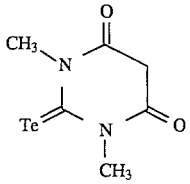

V-9.

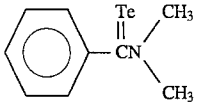

V-10.

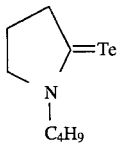

V-11.

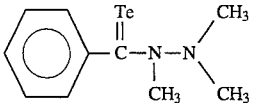

-continued

V-12.

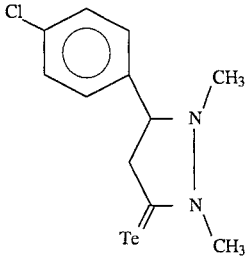

V-13.

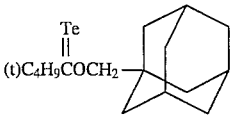

V-14.

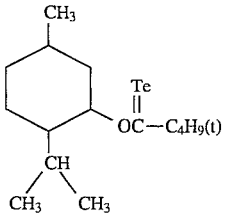

V-15.

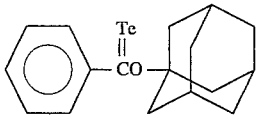

V-16.

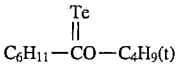

Compounds of formulae (IV) and (V) for use in the present invention may be produced in accordance with known methods. For instance, they may be produced by the methods described in *J. Chem. Soc.* (A), 1969, 2927; *J. Organomet. Chem.*, 4, 320 (1965); ibid., 1, 200 (1963); ibid., 113, C35 (1976); *Phosphorus Sulfur*, 15, 155 (1983); *Chem. Bet.*, 109, 2996 (1976); *J. Chem. Soc. Chem. Commun.*, 635 (1980); ibid., 1102 (1979); ibid., 645 (1979); ibid., 820 (1987); *J. Chem. Soc. Perkin, Trans.*, 1, 2191 (1980); and *The Chemistry of Organo Selenium and Tellurium Compounds*, Vol. 2, 216 to 267 (1987).

The amount of the tellurium sensitizing agent to be in the photographic material of the present invention varies, depending upon the silver halide grains therein and the condition for chemical ripening of them. In general, it is from $10^{-8}$ to $10^{-2}$ mol, preferably from $10^{-7}$ to $5\times10^{-3}$ mol, per mol of silver halide.

The condition of chemical sensitization to be employed in the present invention is not specific. For instance, it is such that the pAg value is generally from 5 to 11, preferably from 6 to 10, and the temperature is generally from 35° to 90° C., preferably, from 40° to 80° C.

In carrying out the present invention, a combination of the tellurium sensitizing agent with other noble metal sensitizing agents, for example, gold, platinum, palladium or iridium is preferred since the photographic material with such combination may have a higher sensitivity. In particular, a combination of the tellurium sensitizing agent and a gold sensitizing agent is preferred. For instance, usable as a gold sensitizing agent for such a purpose are chloroauric acid, potassium chloroaurate, potassium thiocyanatoaurate, gold sulfide and gold selenide. Such a gold sensitizing agent may be used in an amount of, generally, approximately from $10^{-7}$ to $10^{-2}$ mol per mol of silver halide.

In the present invention, a combination of the tellurium sensitizing agent and a sulfur sensitizing agent is also preferred. For instance, usable as a sulfur sensitizing agent for this purpose are known unstable sulfur compounds, such as thiosulfates (e.g., hypo), thioureas (e.g., diphenylthiourea, triethylthiourea, allylthiourea) and rhodanines. Such a sulfur sensitizing agent may be used in an amount of, generally, approximately from $10^{-7}$ to $10^{-2}$ mol, per mol of silver halide.

In the present invention, a combination of the tellurium sensitizing agent and a selenium sensitizing agent is also preferred. Preferably, unstable selenium sensitizing agents as described in JP-A-44-15748 are used for this purpose. For instance, there are mentioned as unstable selenium sensitizing agents, colloidal selenium and compounds of selenoureas (e.g., N,N-dimethylselenourea, selenourea, tetramethylselenourea), selenoamides (e.g., selenoamide, N,N-dimethylselenobenzamide), selenoketones (e.g., selenoacetone, selenobenzophenone), selenides (e.g., triphenylphosphine selenide, diethyl selenide), selenophosphates (e.g., tri-p-tolylselenophosphate), selenocarboxylic acids and selenocarboxylates, and isoselenocyanates. Such a selenium sensitization agent may be used in an amount of, generally, approximately from $10^{-8}$ to $10^{-3}$ mol per mol of silver halide.

In the present invention, a combination of the tellurium sensitizing agent and a reduction sensitizing agent is also preferred. For instance, usable as a reduction sensitizing agent for this purpose are stannous chloride, aminoiminomethanesulfinic acid, hydrazine derivatives, borane compounds (e.g., diethylaminoborane), silane compounds, and polyamine compounds. Such a reduction sensitization agent may be used in an amount of, generally, approximately from $10^{-8}$ to $10^{-3}$ mol, per mol of silver halide.

In the present invention, the tellurium sensitization is preferably effected in the presence of a silver halide solvent. As specific examples of such a silver halide solvent to be used for this purpose, there are mentioned thiocyanates (e.g., potassium thiocyanate), thioether compounds (e.g., those described in U.S. Pat. Nos. 3,021,215 and 3,271,157, JP-B-58-30571, JP-A-60-136736, especially such as 3,6-dithia-1,8-octanediol), tetra-substituted thiourea compounds (e.g., those described in JP-B 59-11892, U.S. Pat. No. 4,221,863, especially such as tetramethylthiourea), thione compounds described in JP-B 60-11341, mercapto compounds described in JP-B 63-29727, mesoion compounds described in JP-A 60-163042, selenoether compounds described in U.S. Pat. No. 4,782,013, telluroether compounds described in JP-A 2-118556, and sulfites. Of them, especially preferred are thiocyanates, thioether compounds, tetra-substituted thiourea compounds and thione compounds. The amount of the silver halide solvent to be used in the present invention is, in general, approximately from $10^{-5}$ to $10^{-2}$ mol, per mol of silver halide.

Color sensitization may be applied to silver halide emulsions for use in the present invention, which is effected so as to impart a spectral sensitivity to light over a desired light wavelength range to the respective emulsions constituting the photographic material of the present invention. Such color sensitization is preferably effected in the present invention by adding to the emulsions dyes or color sensitizing dyes capable of absorbing lights of a wavelength range corresponding to the intended spectral sensitivity of the respective emulsions. As examples of such color sensitizing dyes to be used for this purpose, those described in F. M. Harmer, Heterocyclic Compounds—Cyanine dyes and related compounds (published by John Wiley & Sons, New York, London, 1964) are referred to. Specific examples of such compounds as well as the color sensitization method with them are described in JP-A 62-215272, from page 22, right top column to page 38, which are preferably employed in the present invention.

Next, compounds of formulae (I), (II) and (III) of the present invention are explained in detail hereunder.

In formula (I), X represents an alkali metal atom such as a sodium atom or potassium atom, or an ammonium group such as a tetramethylammonium group or trimethylbenzylammonium group. It also represents a precursor, which is a group capable of yielding a hydrogen or an alkali metal under an alkaline condition. For example, it includes an acetyl group, a cyanoethyl group and a methanesulfonylethyl group.

The alkyl or alkenyl group of $R_1$ in formula (I) includes unsubstituted and substituted ones and also includes alicyclic ones.

As examples of substituents for a substituted alkyl group of $R_1$, there are mentioned a halogen atom, a nitro group, a cyano group, a hydroxyl group, an alkoxy group, an aryl group, an acylamino group, an alkoxycarbonylamino group, a ureido group, an amino group, a heterocyclic group, an acyl group, a sulfamoyl group, a sulfonamido group, a thioureido group, a carbamoyl group, an alkylthio group, an arylthio group, a heterocyclic-thio group, as well as a carboxylic acid group and a sulfonic acid group and salts of them. The ureido group, thioureido group, sulfamoyl group, carbamoyl group and amino group may be unsubstituted, N-alkyl-substituted, and N-aryl-substituted.

As examples of substituents for a substituted alkenyl group of $R^1$, those mentioned for the above-mentioned substituted alkyl group are referred to.

As examples of the aryl group of $R_1$ in formula (I), there are mentioned a phenyl group and a substituted phenyl group. As substituents for the group, an alkyl group and those mentioned for the above-mentioned alkyl group are referred to.

The alkyl group, alkenyl group and aryl group of $R_2$ in formula (II) have the same meaning as those of $R_1$ in formula (I). X in formula (II) has the same meaning as that in formula (I). As examples of the divalent linking group of L in formula (II), mentioned are —N($R^4$)—, —N($R^4$)—CO—, —N($R^4$)—$SO_2$—, —N($R^4$)—CO—N($R^5$)—, —S—, —CH($R^4$)—, —C($R^4$)($R^5$)— and a combination of two or more of them. $R^4$ and $R^5$ each represent a hydrogen atom, an alkyl group or an aralkyl group.

In formula (II), n is 0 or 1.

In formula (III), X has the same meaning as that in formula (i); and L, $R^2$ and n have the same meaning as those in formula (II). $R^3$ has the same meaning as $R^2$ and it may be the same or different from the latter.

As specific examples of compounds of formulae (I), (II) and (III), those mentioned in JP-A-2-123350, pages 10 to 17 are referred to. Of them, especially preferred compounds include, but are not limited to, the following:

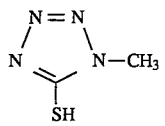

(I-1)

-continued
(I-2)
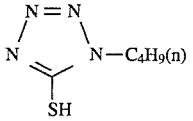
(I-3)
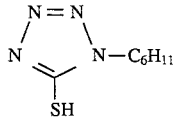
(I-4)
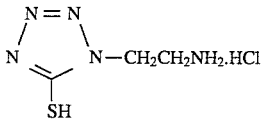
(I-5)
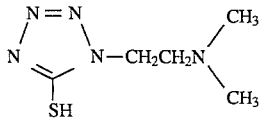
(I-6)
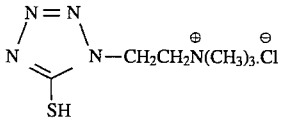
(I-7)
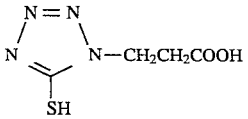
(I-8)
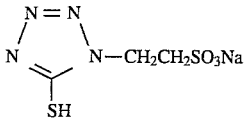
(I-9)
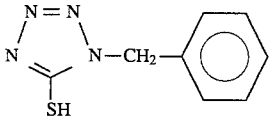
(I-10)
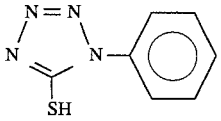
(I-11)
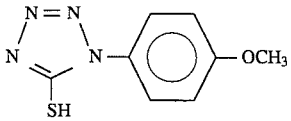
(I-12)
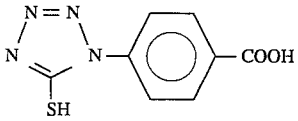
(I-13)
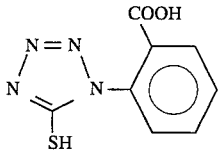
-continued
(I-14)
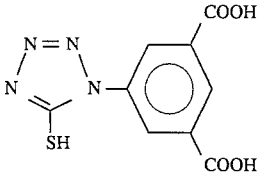
(I-15)
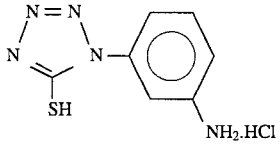
(I-16)
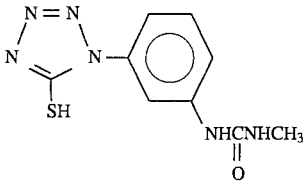
(I-17)
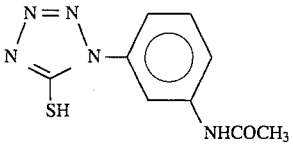
(I-18)
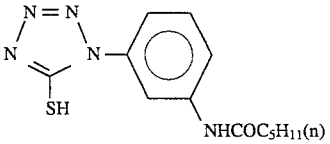
(I-19)
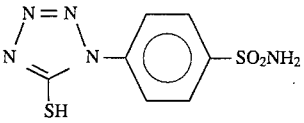
(I-20)
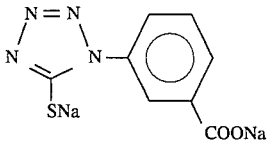
(I-21)
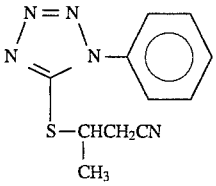
(I-22)
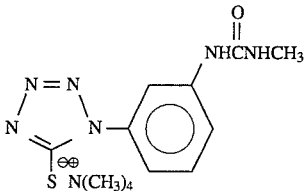
(II-1)
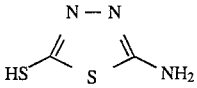
(II-2)
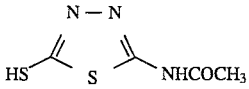

-continued
(II-3)
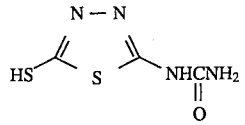
(II-4)
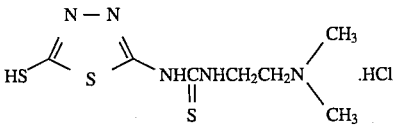
(II-5)
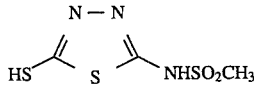
(II-6)
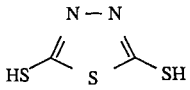
(II-7)
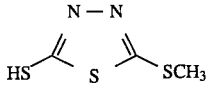
(II-8)
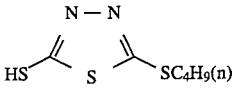
(II-9)
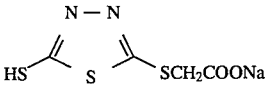
(II-10)
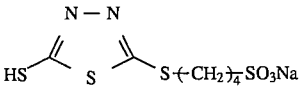
(II-11)
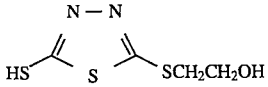
(II-12)
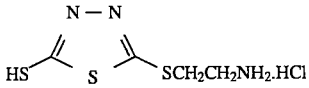
(II-13)
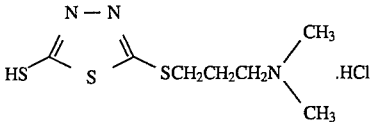
(II-14)
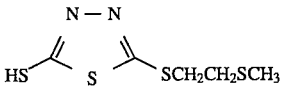
(II-15)
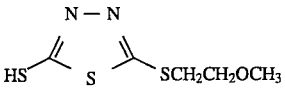
(II-16)
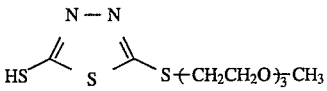
(II-17)
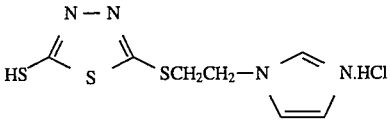
-continued
(II-18)
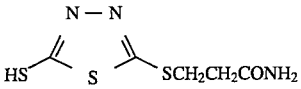
(II-19)
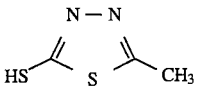
(II-20)
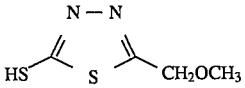
(II-21)
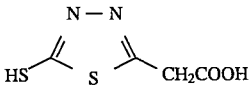
(II-22)
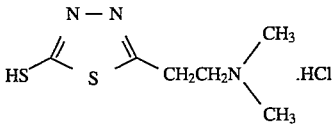
(III-1)
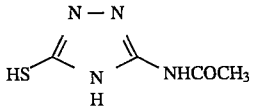
(III-2)
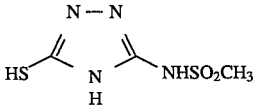
(III-3)
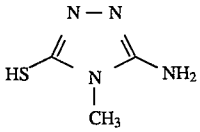
(III-4)
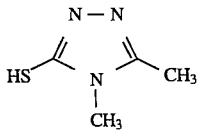
(III-5)
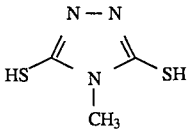
(III-6)
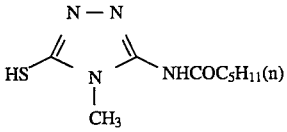
(III-7)
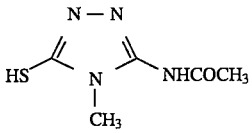

-continued (III-8)

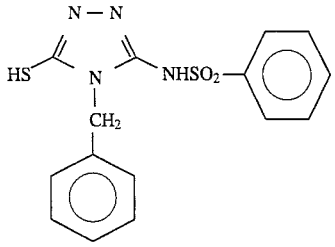

(III-9)

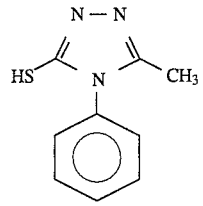

(III-10)

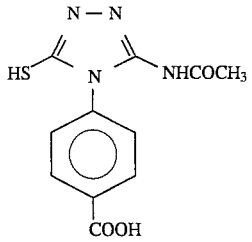

(III-11)

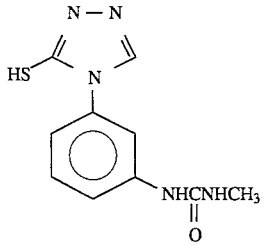

(III-12)

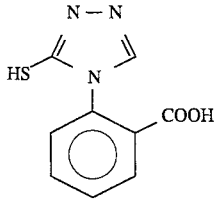

(III-13)

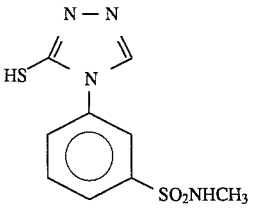

(III-14)

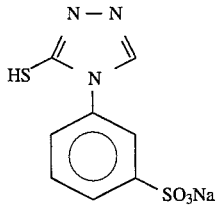

At least one compound of formulae (I), (II) or (III) is incorporated into at least one of the light-sensitive emulsion layers or the non-light-sensitive emulsion layers constituting the photographic material of the present invention and is preferably incorporated into at least one light-sensitive emulsion layer. Regarding the time of adding the compound, it may preferably be added to a silver halide emulsion after completion of physical ripening but before completion of chemical ripening, or to a coating liquid. The former is more preferred. For adding the compound thereto, it is preferred that the compound is previously dissolved in water or an organic solvent (e.g., alcohols such as methanol) prior to addition of it. The amount of the compound to be added is preferably, from $1.0\times10^{-5}$ to $5.0\times10^{-2}$ mol, more preferably, from $1.0\times10^{-4}$ to $1.0\times10^{-2}$ mol, per mol of silver halide.

In addition to compounds of formulae (i), (II) and (III), other various compounds and precursors may be added to the silver halide emulsions constituting the photographic material of the present invention, for the purpose of preventing fogging of the material or for the purpose of stabilizing the photographic properties thereof during the course of manufacture, storage or photographic processing. Examples of such compounds are described in JP-A 62-215272, pages 39 to 72, which are preferably used in the present invention.

The emulsions for use in the present invention are so-called surface latent image type emulsions which essentially form a latent image on the surface of the grain within them.

The photographic material of the present invention preferably has a colored layer as an anti-halation layer which contains a light absorbing agent to be fixed to the colored layer before photographic processing. This colored layer is discolored by photographic processing, which is set forth between the support and a light-sensitive emulsion layer nearest to the support. As a light absorbing agent for this purpose, preferred are colloidal silver and dyes. More preferred is colloidal silver.

Colloidal silver to be used for this purpose may be prepared in accordance with known methods, for example, the methods described in U.S. Pat. Nos. 2,688,601 and 3,459,563 and Belgian Patent 622,695. It is preferred that the colloidal silver for use in the present invention is sufficiently de-salted, after preparation thereof, to have an electric conductivity of 1800 $\mu scm^{-1}$ or less. The amount of the colloidal silver to be in the colloidal silver-containing layer constituting the photographic material of the present invention may be from 0.01 to 0.5 g, preferably, from 0.05 to 0.5 g silver, per $m^2$ of the material.

Preferred dyes which are used in the present invention for the above-mentioned purpose are described in, for example, European Patent 0,337,490A2, pages 27 to 76.

As another preferred embodiment, dyes and cationic polymers for mordanting them are employed. Such mordanting cationic polymers are described in, for example, JP-A-2-84637, pages 18 to 26.

As still another preferred embodiment, fine powdery dyes which are substantially insoluble in water under a pH of at least 6 or less but which are substantially soluble in water under a pH of at least 8 or more may be incorporated into the emulsions of the present invention. Specific examples of such fine powdery dyes, use of them as well as the amount of them to be used are described in JP-A-2-308244, pages 4 to 13.

"The fine powdery dyes used in the present invention which are substantially insoluble in water under a pH of at least 6 or less" means that the fine powdery dye is insoluble so that the dispersion of the fine powdery dye is maintained in a hydrophilic colloid having pH of 6 or less, for example, in gelatin aqueous solution. The powdery dye preferably has a solubility in water of pH 6 of 10 weight % or less, and more preferably 5 weight % or less, at room temperature (24° C.).

Further, "the fine powdery dyes are substantially soluble in water under a pH of 8 or more" means that the fine powdery dye is soluble in such a way that the dispersion of the fine powdery dye is not maintained in an aqueous solution of pH 8 or more. The dye preferably has a solubility in water of pH 6 of 90 weight % or more, and more preferably 95 weight % or more, at a room temperature. The fine powdery dye of the present invention may be water-soluble or water-insoluble at pH 7, is substantially water-insoluble under a pH of at least 6 or less, and is substantially water-soluble under a pH of 8 or more. As the fine powdery dye, dyes represented by the following formulae (I) to (V) are preferably used.

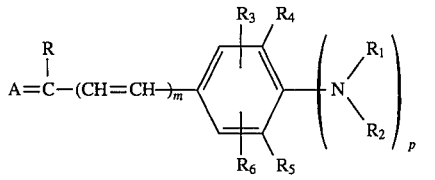

Formula (I)

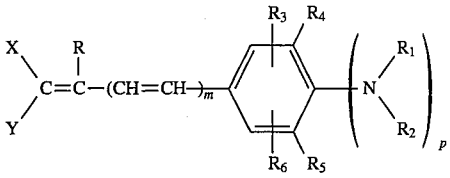

Formula (II)

$$A{=}L_1{-}(L_2{=}L_3)_n{-}A'$$ Formula (III)

$$A{-}(L_1{-}L_2)_{2\text{-}4}{-}B$$ Formula (IV)

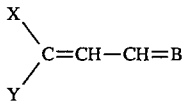

Formula (V)

in which A and A' each are the same or different, and represent an acidic nucleus; B represents a basic nucleus; X and Y each are the same or different, and electron attractive group; R represents a hydrogen atom or an alkyl group; $R_1$ and $R_2$ each represent an alkyl group, an aryl group, an acyl group or a sulfonyl group, $R_1$ and $R_2$may combine each other to form 5-membered or 6-membered ring; $R_3$ and $R_6$ each represent a hydrogen atom, an alkyl group, a hydroxy group, a carboxyl group, an alkoxy group or a halogen atom; $R_4$ and $R_5$ each represent a hydrogen atom or non-metallic atoms which is required to form a 5-membered or 6-membered ring together with $R_1$ and $R_4$, or together with $R_2$ and $R_3$; $L_1$, $L_2$, and $L_3$ each represent a methine group; m represent 0 or 1; n and q each represent 0, 1 or 2; p represents 0 or 1 and when p represent 0, $R_3$ represent a hydroxy group or a carboxyl group and $R_4$ and $R_5$ represents a hydrogen atom.

The compound represented by the formula (I), (II), (III), (IV) or (V) has at least one releasing group having a pK value within the range of 4 to 11 in a molecule which is obtained in a mixing solution of water and ethanol (1/1 by volume ratio).

The details of the formulae (I), (II), (III), (IV) and (V) are explained below.

"The acidic nucleus represented A or A" preferably is 2-pyrazoline-5-one, rhodanine, hydantoin, thohydantoin, 2,4-oxazolidinedione, iooxazolidinone, barbituric acid, thiobarbituric acid, indandione, pyrazolopyridine or hydroxypyridone.

The basic nucleus represented by B preferably is pyridine, quinoline, indolenine, oxazole, benzooxazole, naphthooxazole or pyrrole.

The dissociative group having pKa value (acid dissociation constant) within the range of 4 to 11 in a mixing solution having volume ration of 1:1 (water: ethanol) has no specific limitation in it's kind and in a substitution-position to the dye molecule, as long as the group makes the dye molecule substantially water-insoluble under pH of 6 or less, substantially water-soluble under pH of 8 or more, but the preferable dissociative group is preferably a carboxyl group, sulfamoyl group, a sulfinamido group, an amino group or a hydroxyl group, and more preferably a carboxyl group. The dissociative group may be substituted directly to the dye molecule, and also may be substituted to the dye molecule through a divalent linking group, for example, an alkylene group, a phenylene group.

The group via a divalent linking group may be 4-carboxyphenyl, 2-methyl-3-carboxyphenyl, 2,4-dicarboxyphenyl, 3,5-dicarboxyphenyl, 3-carboxyphenyl, 2,5-dicarboxyphenyl, 3-ethylsulfamoylphenyl, 4-phenylsulfamoylphenyl, 2-carboxyphenyl, 2,4,6,trihydroxyphenyl, 3-benzenesulfonamidophenyl, 4-(p-diaminobenzenesulfonamido)phenyl, 3-hydroxyphenyl, 2-hydroxyphenyl, 4-hydroxyphenyl, 2-hydroxy-4-carboxyphenyl, 3-methoxy-4-carboxyphenyl, 2-methyl,4-phenylsulfamoylphenyl, 4-carboxybenzene, 2-carboxybenzyl, 3-sulfamoylphenyl, 4-sulfamoylphenyl, 2,5-disulfamoylphenyl, carboxymethyl, 2-carboxyethyl, 3-carboxypropyl, 4-carboxybutyl or 8-carboxyoctyl.

The alkyl group represented by R, $R_3$, or $R_6$ preferably is an alkyl group having 1 to 10 carbon atoms, such as methyl, ethyl, n-propyl, isoamyl, n-octyl.

The alkyl group represented by $R_1$ and $R_2$ preferably is an alkyl group having 1 to 20 carbon atoms, such as methyl, ethyl, n-propyl, n-butyl, n-octyl, n-octadecyl, isobutyl, isopropyl, and may have a substituent, such as a halogen atom, e.g., chlorine, bromide; a nitro group; a cyano group; a hydroxy group; a carboxy group; an alkoxy group, such as methoxy, ethoxy; an alkoxycarbonyl group, such as methoxycarbonyl, i-propoxycarbonyl; an aryloxy group, such as phenoxy; a phenyl group, an amido group, such as acetylamino, methnesulfoneamido; a carbamoyl group, such as methylcarbamoyl, ethylcarbamoyl; a sulfamoyl, group, such as methylsulfamoyl, phenylsulfamoyl.

The aryl group represented by $R_1$ and $R_2$ preferably is a phenyl group, or a naphthyl group, and may have a substituent including those disclosed above as the substituents which may be substituted on the alkyl group represented by $R_1$and $R_2$ or an alkyl group, such as methyl, ethyl.

The acyl group represented by $R_1$ and $R_2$ preferably is an acyl group having 2 to 10 carbon atoms, such as acetyl, propionyl, n-octanoyl, n-decanoyl, isobutanoyl or benzoyl group.

The alkylsulfonyl group or an arylsulfonyl group represented by $R_1$ or $R_2$ preferably is methanesulfonyl, ethanesulfonyl, n-butanesulfonyl, n-octanesulfonyl, benzenesulfonyl, p-toluenesulfonyl or o-carboxybenzenesulfonyl group.

The alkoxy group represented by $R_3$ and $R_6$ preferably is a chlorine, bromine or fluorine atom.

The halogen atom represented by $R_3$ and $R_6$ preferably is a chlorine, bromine or fluorine atom.

The 5-membered or 6-membered ring formed by linking $R_1$ with $R_4$or $R_2$ with $R_5$ includes, for example, jurolidine ring.

The 5-membered or 6-membered ring formed by linking $R_1$ with $R_2$includes, for example, pyperidine, morphorine, or pyrolidine ring.

The methine group represented by $L_1$, or $L_2$ or $L_3$ means a methine group having a substituent such as methyl, ethyl cyano, phenyl, chlorine, hydroxypropyl.

The electron attractive group represented by X or Y may be the same or different from each other, and includes a cyano group; a carboxy group; an alkylcarbonyl group, which may be substituted, such as acetyl, propionyl, heptanoyl, dodecanoyl, hexadecanoyl, 1-oxo-7 -chloroheptyl; an arylcarbonyl group, which may be substituted, such as benzoyl, 4-ethoxycarbonylbenzoyl, 3-chlorobenzoyl; an alkoxycarbonyl group, which may be substituted, such as methoxycarbonyl, ethoxycarbonyl, butoxycarbonyl, t-amyloxycarbonyl, hexyloxycarbonyl, 2-ethylhexyloxycarbonyl, octyloxycarbonyl, decyloxycarbonyl, dodecyloxycarbonyl, hexadecyloxycarbonyl, 2-butoxyothoxycarbonyl, 2-methylsulfonylethoxycarbonyl, 2-cyanoethoxycarbonyl, 2-(2-chloroethoxy)ethoxycarbonyl, 2-[2-92-chloroethoxy)ethoxy] ethoxycarbonyl); an aryloxycarbonyl, which may be substituted, such as carbamoyl, ethylcarbamoyl, dodecylcarbamoyl, phenylcarbamoyl, 4-methoxyphenylcarbamoyl, 2-bromopyenylcarbamoyl, 4-methoxyphenylcarbamoyl, 2-bromoyenylcarbamoyl, 4-chlorophenylcarbamoyl, 4-ethocycarbonylphenyl, carbamoyl, 4-cyanophenylcarbamoyl, 3-methylphenylcarbamoyl, 4-hexyloxyphenylcarbamoyl, 2,4-di-(t-amyl)phenylcarbamoyl, 2-chloro-3-(dodecyloxycarbonyl)phenylcarbamoyl, 3-(hexyloxycarbonyl)phenylcarbamoyl; a sulfonyl group, such as methylsulfonyl, phenylsulfonyl; or a sulfamoyl, which may be substituted, such as sulfamoyl, methylsulfamoyl.

The dyes used in the present invention are illustrated in the follwoing but is not limitative thereto.

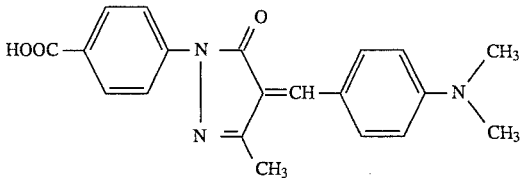

I-1

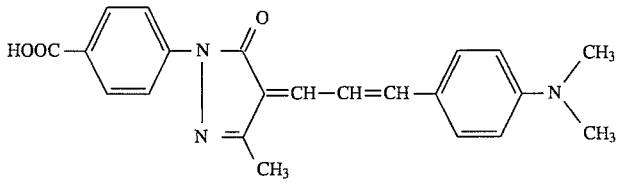

I-2

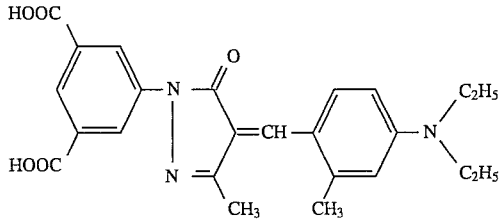

I-3

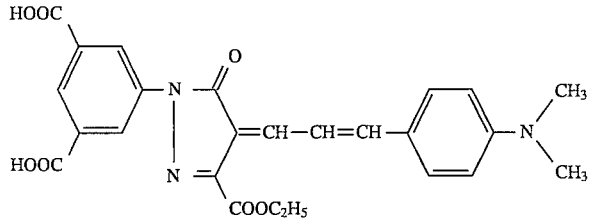

I-4

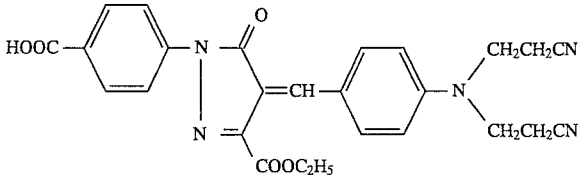

I-5

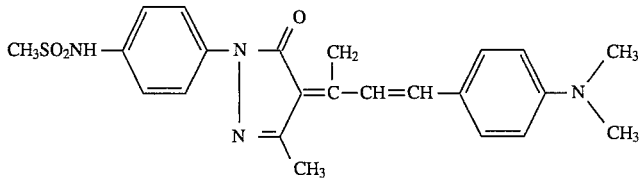

I-6

-continued
I-7
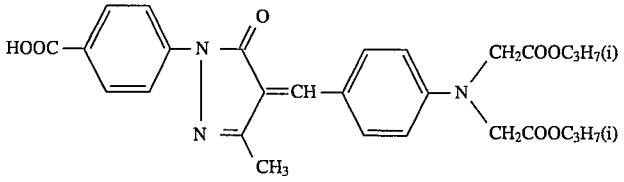
I-8
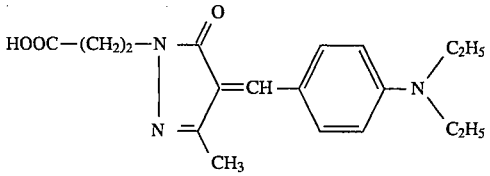
I-9
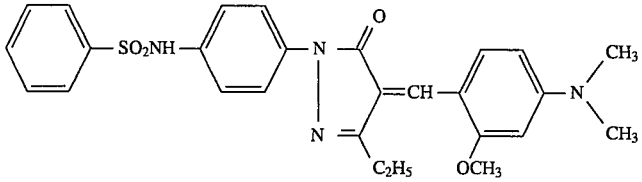
I-10
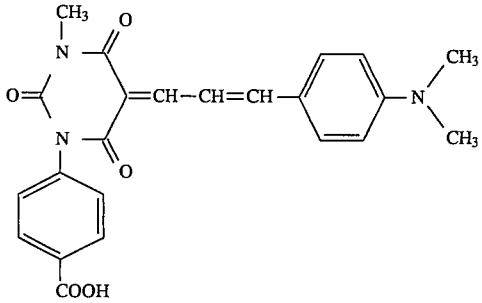
I-11
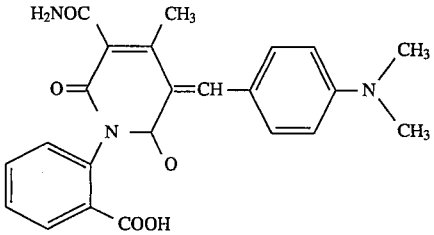
I-12
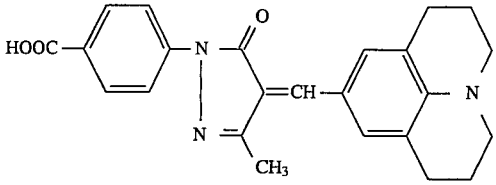
I-13
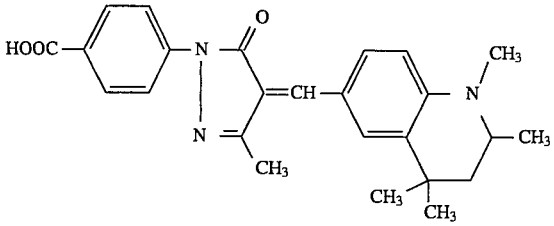

-continued
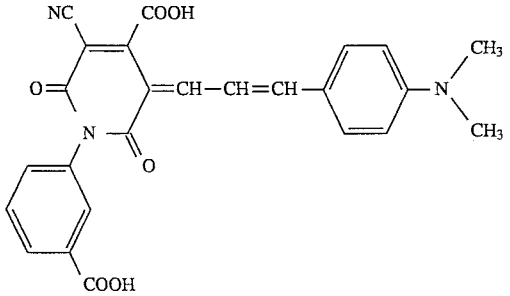
I-14
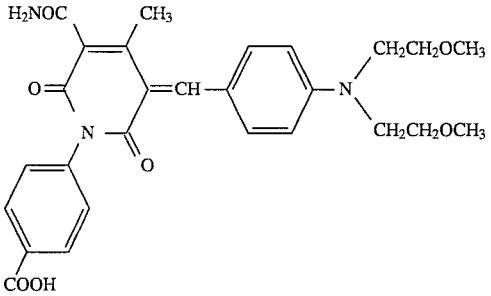
I-15
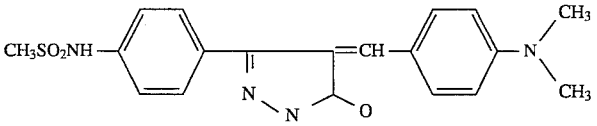
I-16
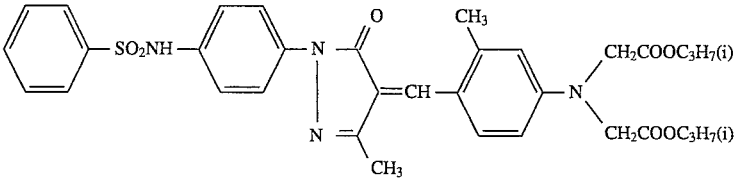
I-17
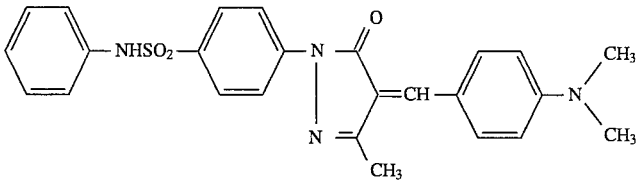
I-18
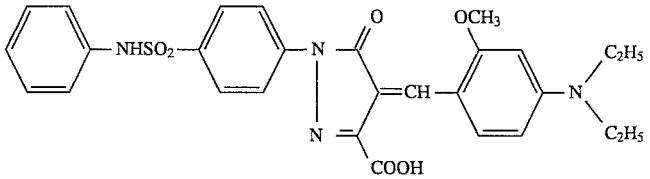
I-19
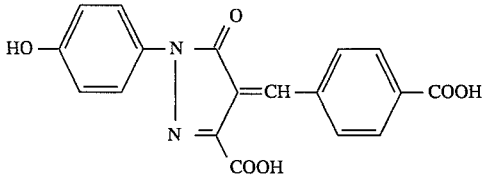
I-20
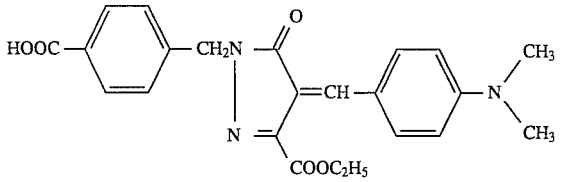
I-21

-continued
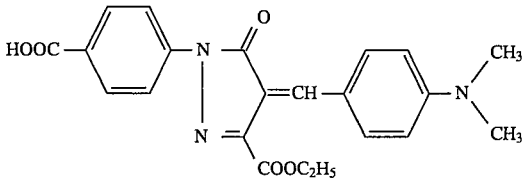
I-22
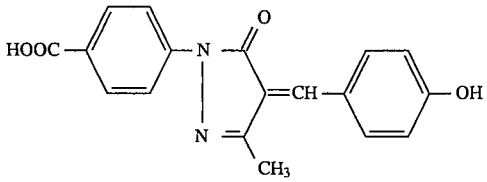
I-25
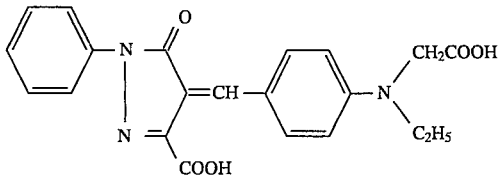
I-26
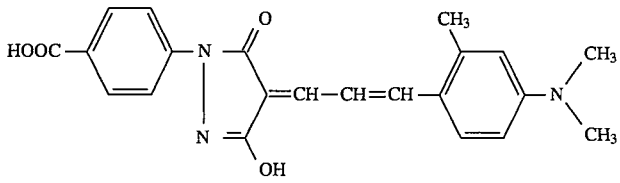
I-27
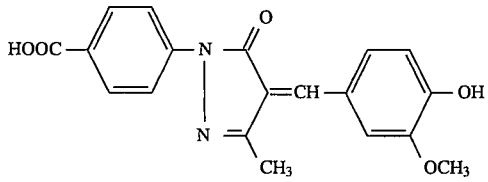
I-28
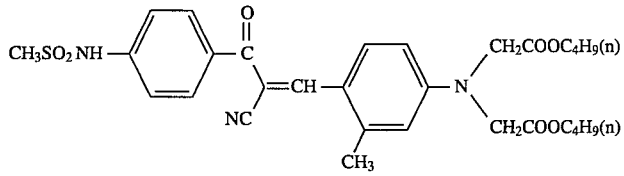
II-1
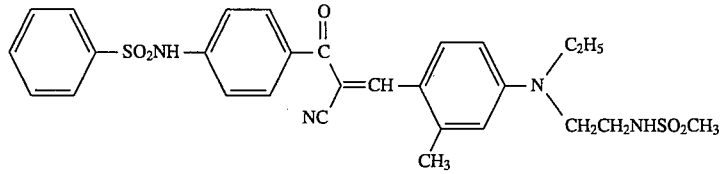
II-2
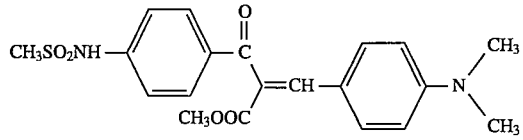
II-3
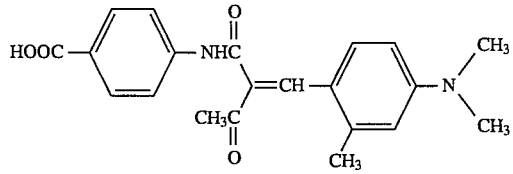
II-4

-continued
II-5
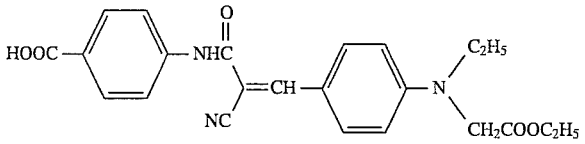
II-6
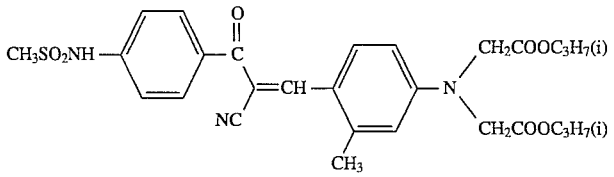
III-1
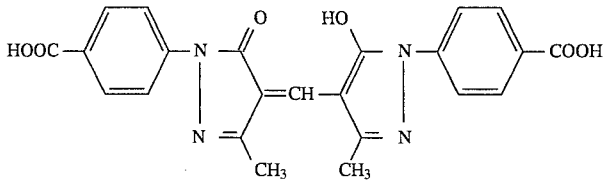
III-2
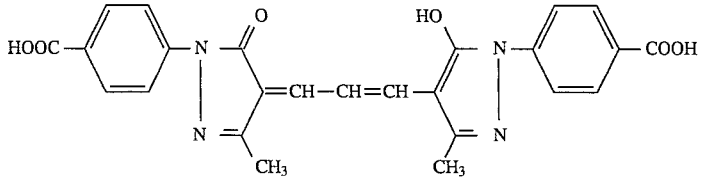
III-3
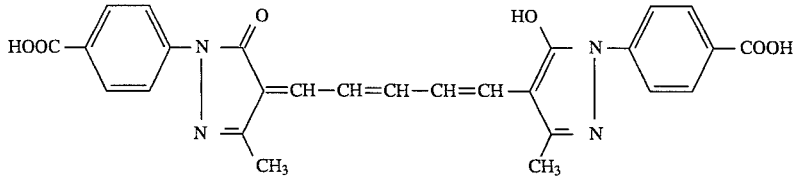
III-4
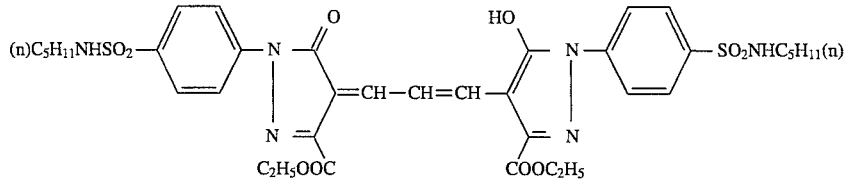
III-5
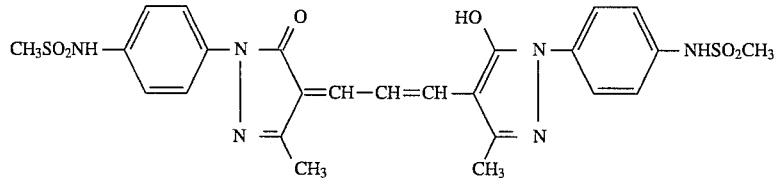
III-6
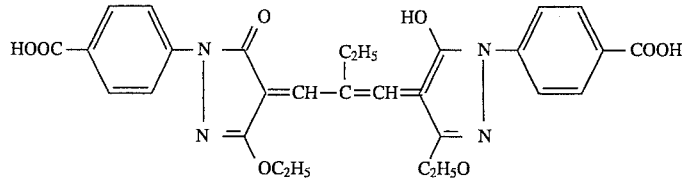
III-7
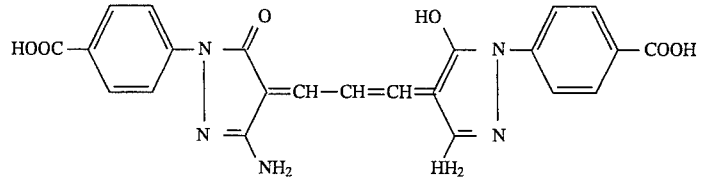

-continued
III-8
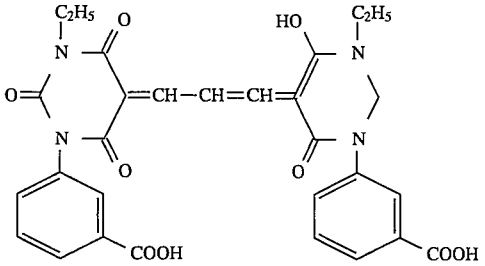
III-9
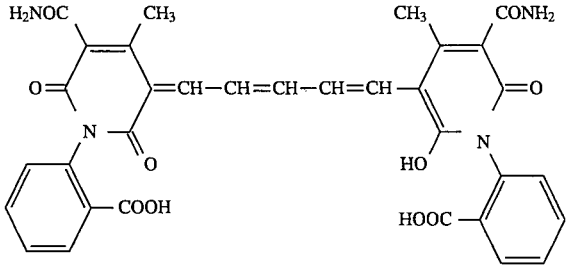
III-10
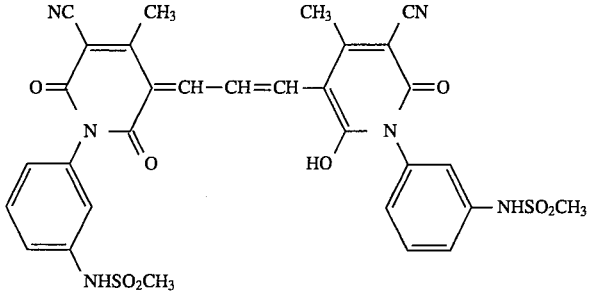
III-11
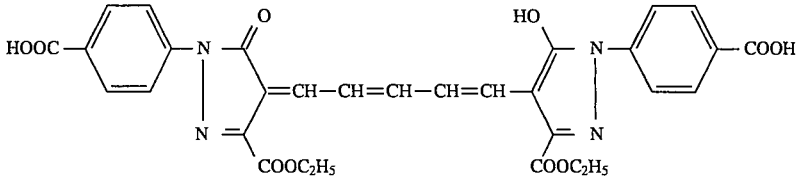
III-12
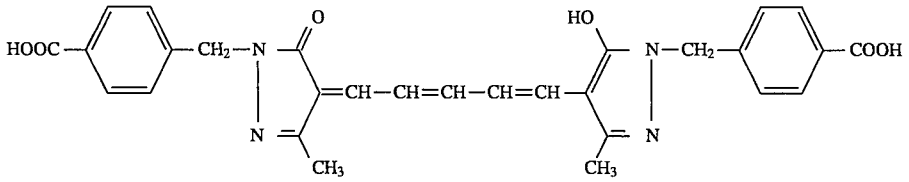
III-13
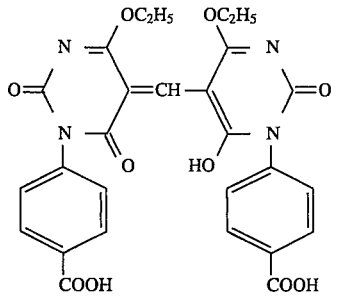
III-14
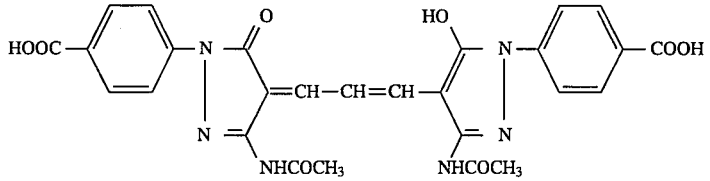

-continued
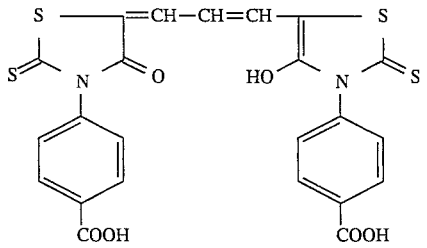
III-15
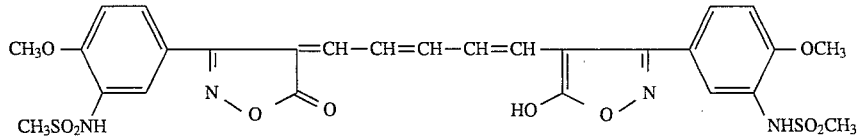
III-16
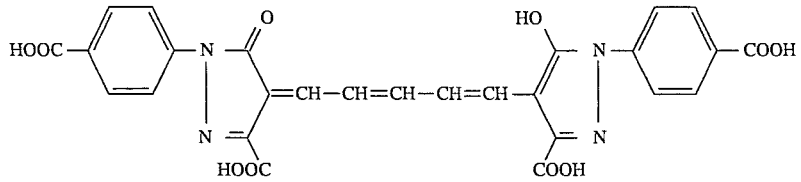
III-17
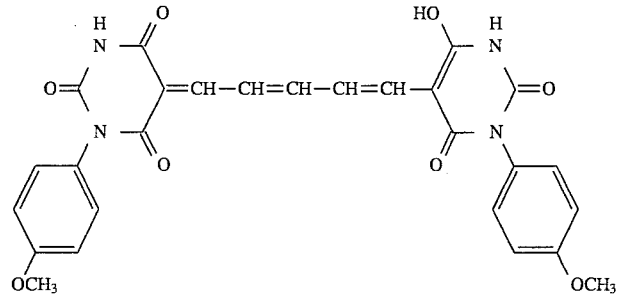
III-18
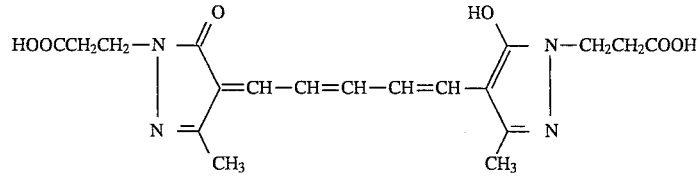
III-19
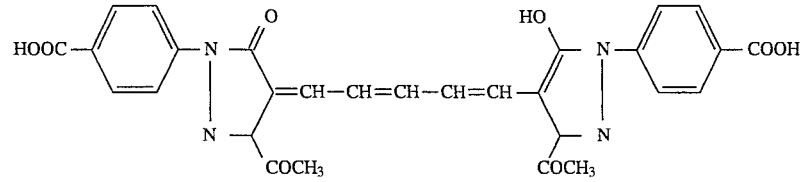
III-20
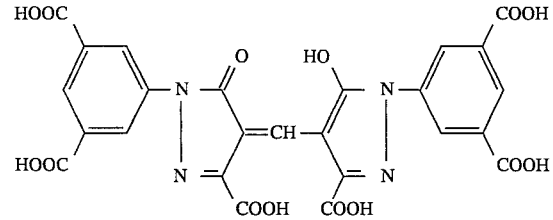
III-21
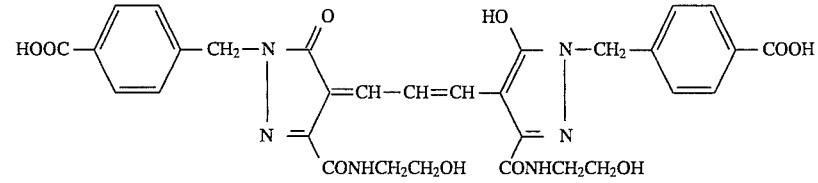
III-22

-continued
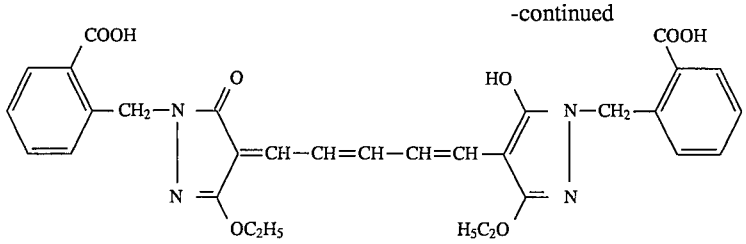
III-23
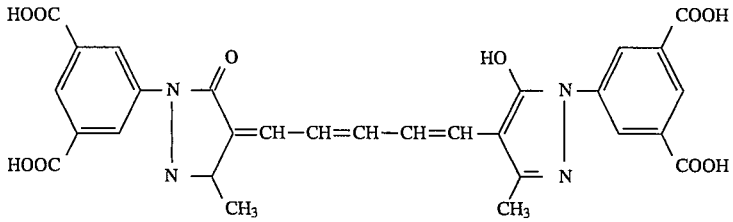
III-24
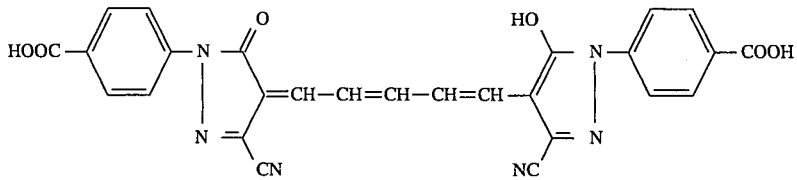
III-25
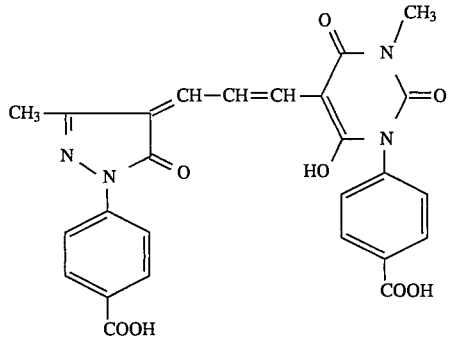
III-26
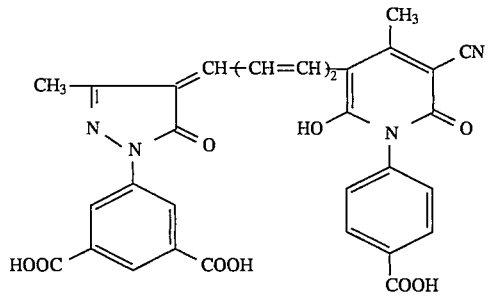
III-27
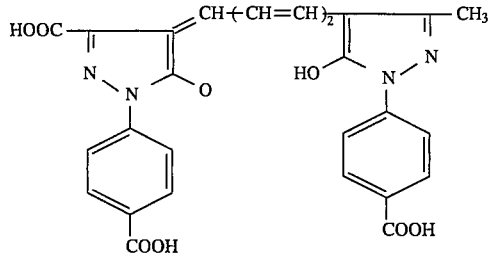
III-28

-continued
III-29
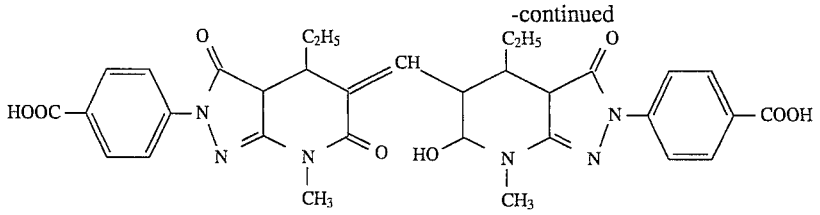
III-30
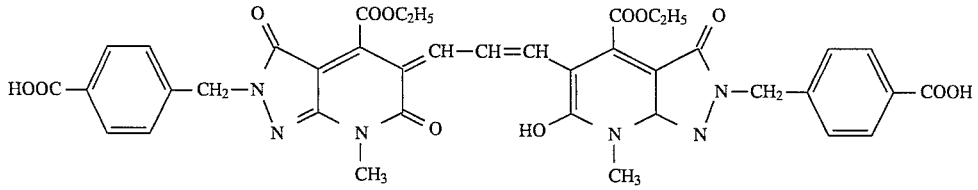
III-31
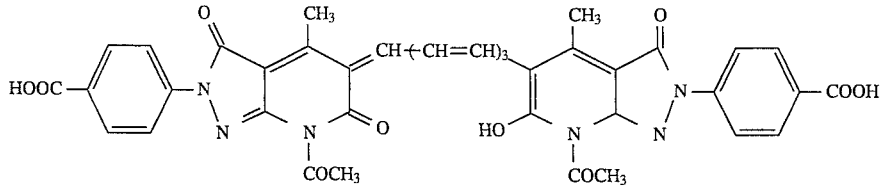
III-32
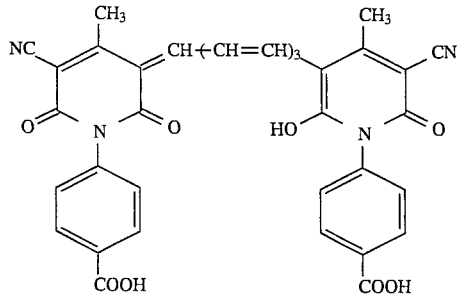
III-33
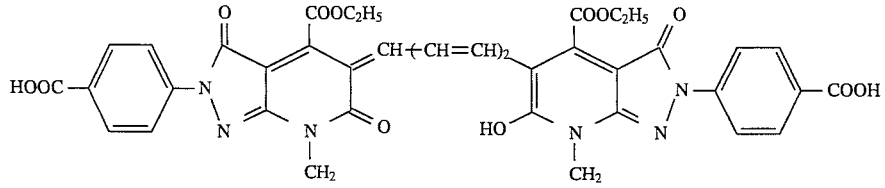
III-34
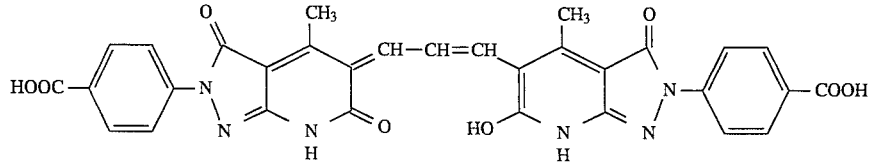
III-35
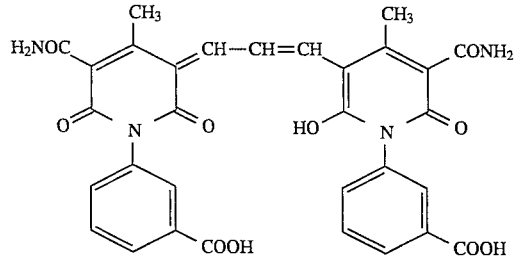

-continued
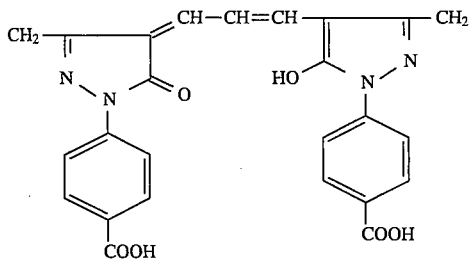
III-36
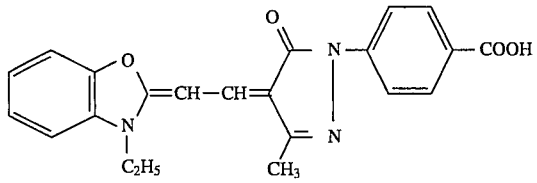
IV-1
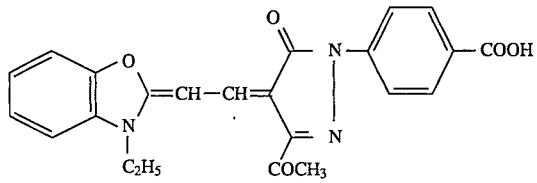
IV-2
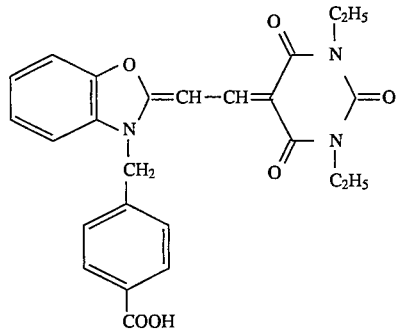
IV-3
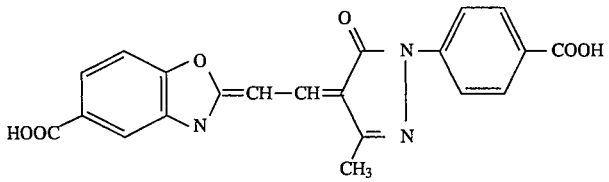
IV-4
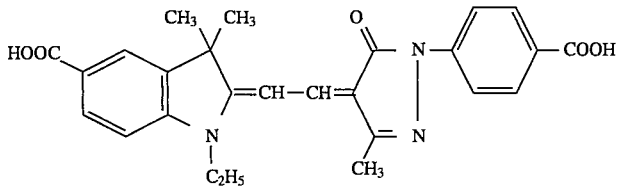
IV-5
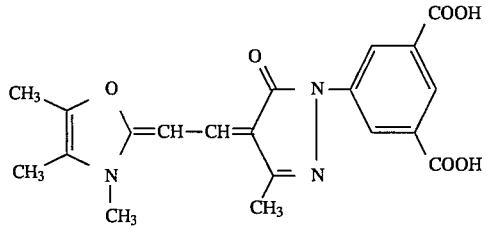
IV-6

-continued
IV-7
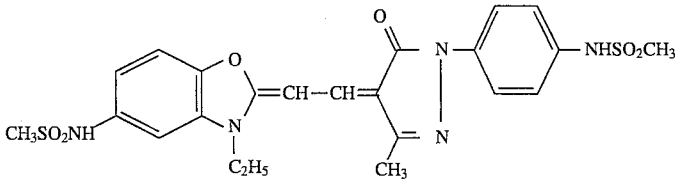
IV-8
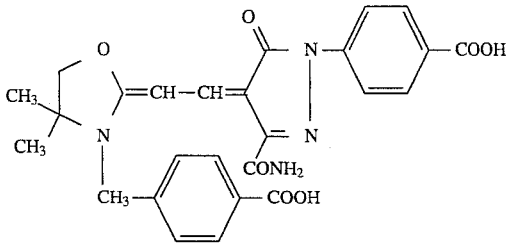
IV-9
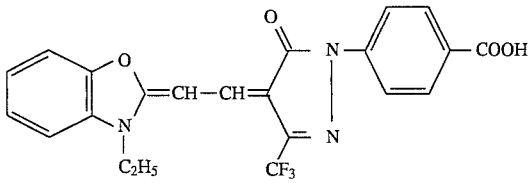
IV-10
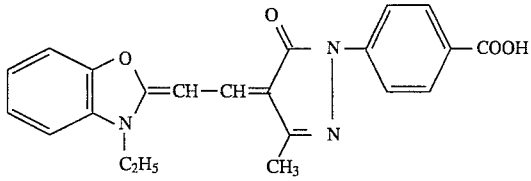
IV-11
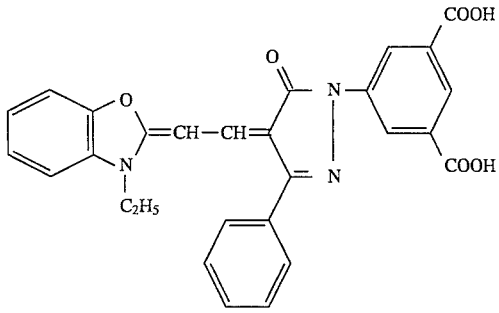
IV-12
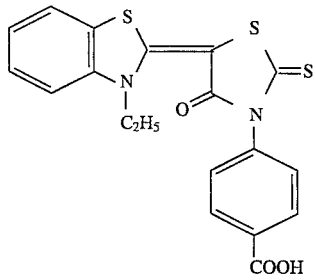

-continued
IV-13
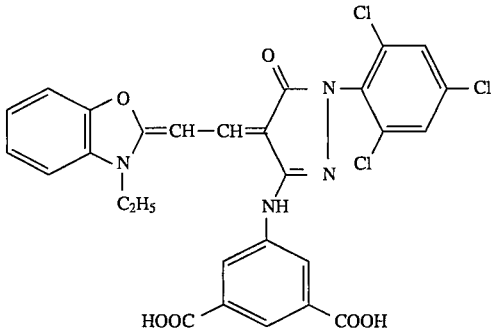
IV-14
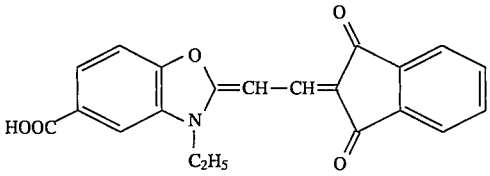
IV-15
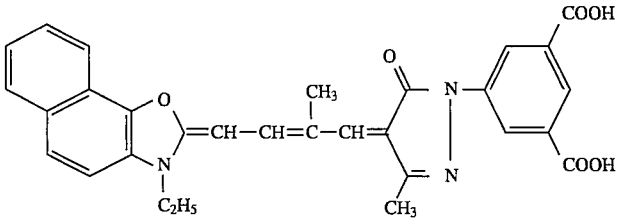
IV-16
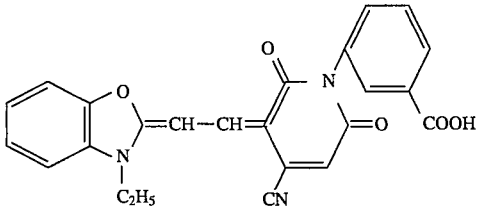
V-1
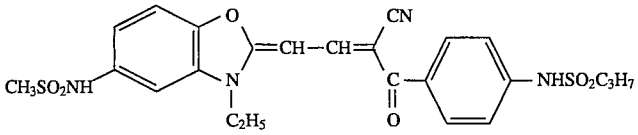
V-2
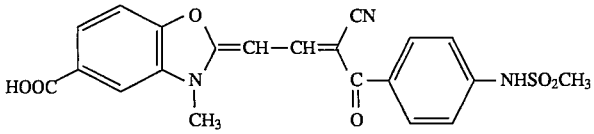
V-3
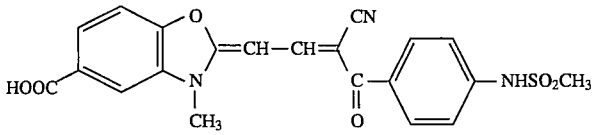
V-4
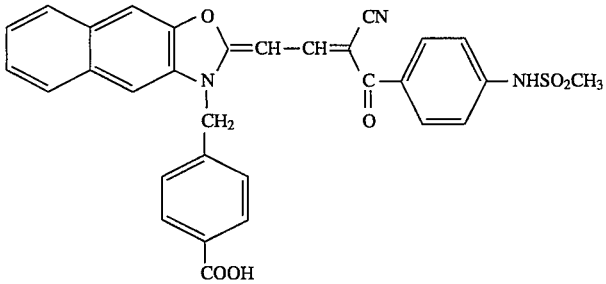

-continued

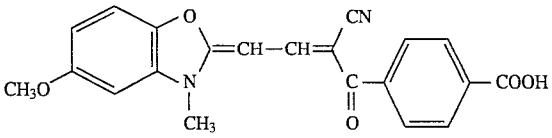

V-5

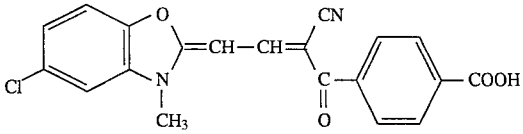

V-6

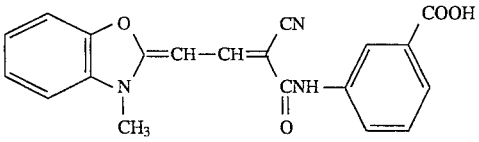

V-7

The dyes used in the present invention are synthesized by methods or similar methods thereto which are disclosed in WO 8/04794, EP 0274723A1, ibid 276,566, ibid 299,435, JPA-52-92716, ibid 55-155350, ibid 55-155351, ibid 61-205934, ibid 48-68623, U.S. Pat. Nos. 2,527,583, 3,486, 879, 3,746,539, 3,933,798, 4,130,429, 4,040,841, etc.

The method in which a specific layer is dyed with water-insoluble solid dye is disclosed in JPA-56-12639, JPA-55-155350, JPA-155351, JPA 63-27838, JPA-63-1979423, EP Patents 15,601, 274,723, 276,566, 299,435 and WO (Laid Open) 88/04794. However, the method does not improve the problem caused when a thin support is used, and therefore, the effect of the present invention in which fine particles dye is used and thereby decrease of sensitivity under high humidity is inhibited, which is entirely unexpected.

In the present invention, dye which is substantially water-insoluble under Ph 6.0 or less is preferably dispersed in a form of fine powder in a colloid together with a dispersing aid according to the procedure disclosed in WO 88/04794, EP Patent 0276566 and JPA-63-197943. The "in a form of fine powder" means a state of dispersion in which fine particles having an average diameter (projected method or similar to circle) of 1 μm or less, preferably 0.5 μm to 0.01 μm and being substantially non-diffusible to the adjacent layer in a colloidal layer and causing no aggregation to form 3 μm or more of grains are dispersed.

The dispersion aid may be a conventional nonionic surfactant, anionic surfactant, or ampholytic surfactant, including, for example, the compounds w-1 to W-99 which are disclosed in JPA-62-215272, at page 20, left lower column to page 210, right upper column, and the surfactants represented by formula (VII), (VIII) and (IX) disclosed in JPB-56-36415, JPB-59-31668 and JPA-63-282738.

Examples thereof are shown below.

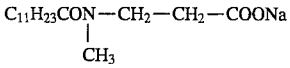

(1)

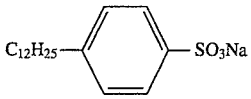

(2)

-continued

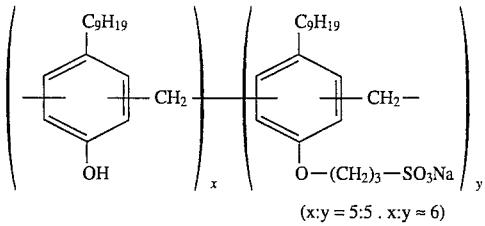

(3)

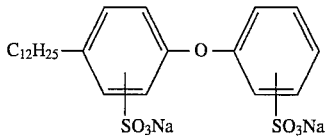

(4)

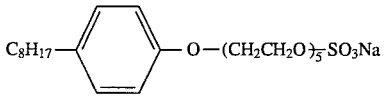

(5)

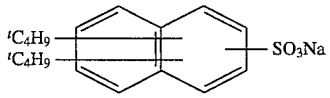

(6)

For the purpose of improving the sharpness of the image to be formed in the photographic material of the present invention, it is also preferred to incorporate 12% by weight or more (preferably 14% by weight or more) of titanium oxide as surface-treated with a dihydric or For the dispersion aid, water-soluble organic solvent, for example, dimethylformamide, methylalcohol, ethylalcohol, dimethylsulfonylamide, etc. may be used. For the dispersion medium, a hydrophilic colloid, for example, gelatin, casein, hydroxylethylcellulose, poly-N-vinylprollidone, polyacrylic acid and gelatin derivatives, or alkaline water, may be used.

The fine powder dispersion is obtained by a method in which the solid dye is dissolved in a water-soluble organic solvent and then dispersed in a colloidal aqueous solution having neutral or acidic pH value, and most preferably the solid dye is wetted with water or insoluble liquid, mixed and the wetted dye is mixed with a dispersion aid, milled to make fine grains and dispersed in a colloidal aqueous solution. The solid dye may also be subject to supersonic waves to form fine grains and dispersed in a colloidal aqueous solution with a surfactant as a dispersion aid, or the solid dye may be dissolved in an alkaline water and dispersed in acidic colloidal aqueous solution, etc.

For a dye, or colloidal aqueous solution, an organic acid, for example, citric acid, oxalic acid, acetic acid or tartaric acid are used therewith.

The fine powdery dye used in the present invention may be fine crystal of dye, fine grains in a micell structure or fine aggregated grains. The diameter of the fine grains is obtained by examination and measurement of the section of intercept of the colloidal layer containing the fine grains using transmission electron microscope.

In the present invention, "a hydrophilic colloidal layer containing the fine powdery dye" means a light-insensitive layer, for example, halation inhibiting layer, irradiation inhibiting layer filter layer subbing layer intermediate layer, color mixing inhibiting layer, ultraviolet ray absorbing layer and protective layer, or a light-sensitive layer (silver halide emulsion layer). The content of the fine powdery dye is preferably 5 to 1000 mg/m$^2$ and more preferably 10 to 200 mg/m$^2$. tetrahydric alcohol (e.g., trimethylolethane), to the water-proofing resin layer of the support.

It is preferred that photographic additives such as cyan, magenta and yellow couplers to be added to the photographic material of the present invention are dissolved in a high boiling point organic solvent before addition of them. Such a high boiling point organic solvent may be any and every good solvent to couplers, which is a water-immiscible compound having a melting point of 100° C. or lower and having a boiling point of 140° C. or higher. The melting point of the high boiling point organic solvent is preferably 80° C. or lower; and the boiling point thereof is preferably 160° C. or higher, more preferably 170° C. or higher.

The details of such high boiling point organic solvents are described in JP-A 62-215272, from page 137, right bottom column to page 144, right top column.

Cyan, magenta and yellow couplers may also be emulsified and dispersed in an aqueous colloidal solution by previously infiltrating them into a loadable latex polymer (for example, as described in U.S. Pat. No. 4,203,716) in the presence or absence of the above-mentioned high boiling point organic solvent or by previously dissolving them in a water-insoluble and organic solvent-soluble polymer.

For this purpose, preferably used are homopolymers and copolymers as described in U.S. Pat. No. 4,857,449, columns 7 to 15 and International Patent Laid-Open WO88/00723, pages 12 to 30. More preferred are methacrylate or acrylamide polymers, especially acrylamide polymers, for satisfactory stabilization of the color image to be formed in the photographic material of the present invention.

The photographic material of the present invention preferably contains a color image preservability improving compound, for example, one as described in European Patent 0,277,589A2, along with couplers. Incorporation of such a color image preservability improving compound into the material along with a pyrazoloazole magenta coupler is preferred.

Specifically, single or combined incorporation of a compound (F) (which may bind with the aromatic amine developing agent remaining in the photographic material after color development thereof by chemical bond to form a chemically inactive and substantially colorless compound), and a compound (G) (which may bind with the oxidation product of an aromatic amine developing agent remaining in the photographic material after color development thereof by chemical bond to form a chemically inactive and substantially colorless compound) into the photographic material of the present invention is preferred for the purpose of preventing formation of color dyes by reaction of the color developing agent or the oxidation product thereof remaining in the photographic material and couplers in the material during storage of the processed material (which causes formation of stains in the processed material during storage thereof), and also preventing any other harmful side effect of the remaining agent and oxidation product thereof.

The photographic material of the present invention also preferably contains an antifungal substance, such as one described in JP-A-63-271247, for the purpose of preventing propagation of various fungi and bacteria in the hydrophilic colloid layer of the processed material which would deteriorate the image formed on the material.

As a support to be in the photographic material of the present invention, a white polyester support or a support having a white pigment-containing layer on the side facing the silver halide emulsion layers coated thereover may be employed for displays.

The photographic material of the present invention may be exposed either with visible rays or with infrared rays. For exposure of the material, either low intensity exposure or high intensity short-time exposure may be employed. In particular, in the latter case, a laser scanning exposure system is preferred where the exposure time is shorter than $10^{-4}$ second per pixel.

In exposure of the photographic material of the present invention, a band stop filer described in U.S. Pat. No. 4,880,726 is preferably used. Using it, rays causing color mixture may be removed so that the color reproducibility of the exposed material is improved noticeably.

The exposed photographic material of the present invention is subjected to conventional black-and-white or color development. Where the material is a color photographic material, it is preferably subjected to bleach-fixation after color development thereof, for the purpose of attaining rapid processing of the material. In particular, where the material contains the above-mentioned high silver chloride emulsion, the pH value of the bleach-fixing solution to be applied to the material is preferably about 6.5 or less, more preferably, about 6 or less, for the purpose of accelerating desilvering of the material.

As silver halide emulsions and other elements (e.g., additives, etc.) constituting the photographic material of the present invention, photographic layers constituting the material (e.g., arrangement of layers), and methods of processing the material and additives usable in the processing methods, those described in the following patent publications, especially in European Patent 0,355,660A2, corresponding to JP-A-2-139544, are preferably employed.

| Photographic Elements | JP-A-62-215272 | JP-A-2-33144 | EP 0,355,660A2 |
|---|---|---|---|
| Silver Halide Emulsions | From page 10, right upper column, line 6 to page 12, left lower column, line 5; and from page 12, right lower column, line 4 to page 13, left upper column, line 17 | From page 28, right upper column, line 16 to page 29, right lower column, line 11; and page 30, lines 2 to 5 | From page 45, line 53 to page 47, line 3; and page 47, lines 20 to 22 |

-continued

| Photographic Elements | JP-A-62-215272 | JP-A-2-33144 | EP 0,355,660A2 |
|---|---|---|---|
| Silver Halide Solvents | Page 12, left lower column, lines 6 to 14; and from page 13, left upper column, line 3 from below to page 18, left lower column, last line | — | — |
| Chemical Sensitizers | Page 12, from left lower column, line 3 from below to right lower column, line 5 from below; and from page 18, right lower column, line 1 to page 22, right upper column, line 9 from below | Page 29, right lower column, line 12 to last line | Page 47, lines 4 to 9 |
| Color Sensitizers (Color Sensitizing Methods) | From page 22, right upper column, line 8 from below to page 38, last line | Page 30, left upper column, lines 1 to 13 | Page 47, lines 10 to 15 |
| Emulsion Stabilizers | From page 39, left upper column, line 1 to page 72, right upper column, last line | Page 30, from left upper column, line 14 to right upper column, line 1 | Page 47, lines 16 to 19 |
| Development Promoters | From page 72, left lower column, line 1 to page 91, right upper column, line 3 | — | — |
| Color Couplers (Cyan, Magenta and Yellow Couplers) | From page 91, right upper column, line 4 to page 121, left upper column, line 6 | From page 3, right upper column, line 14 to page 18, left upper column, last line; and from page 30, right upper column, line 6 to page 35, right lower column, line 11 | Page 4, lines 15 to 27; from page 5, line 30 to page 8, last line; page 45, lines 29 to 31; and from page 47, line 23 to page 63, line 50 |
| Coloring Enhancers | From page 121, left upper column, line 7 to page 125, right upper column, line 1 | — | — |
| Ultraviolet Absorbents | From page 125, right upper column, line 2 to page 127, left lower column, last line | From page 37, right lower column, line 14 to page 38, left upper column, line 11 | Page 65, lines 22 to 31 |
| Anti-fading Agents (Color Image Stabilizers) | From page 127, right lower column, line 1 to page 137, left lower column, line 8 | From page 36, right upper column, line 12 to page 37, left upper column, line 19 | From page 4, line 30 to page 5, line 23; from page 29, line 1 to page 45, line 25; page 45, lines 33 to 40; and page 65, lines 2 to 21 |
| High Boiling Point and/or Low Boiling Point Organic Solvents | From page 137, left lower column, line 9 to page 144, right upper column, last line | From page 35, right lower column, line 14 to page 36, left upper column, line 4 from below | Page 64, lines 1 to 51 |
| Dispersing Methods of Photographic Additives | From page 144, left lower column, line 1 to page 146, right upper column, line 7 | From page 27, right lower column, line 10 to page 28, left upper column, last line; and from page 35, right lower column, line 12, to page 36, right upper column, line 7 | From page 63, line 51 to page 64, line 56 |
| Hardening Agents | From page 146, right upper column, line 8 to page 155, left lower column, line 4 | — | — |
| Developing Agent Precursors | Page 155, from left lower column, line 5 to right lower column, line 2 | — | — |
| Development Inhibitor Releasing Compounds | Page 155, right lower column, lines 3 to 9 | — | — |
| Supports | From page 155, right | From page 38, right | From page 66, line 29 |

-continued

| Photographic Elements | JP-A-62-215272 | JP-A-2-33144 | EP 0,355,660A2 |
|---|---|---|---|
| | lower column, line 19 to page 156, left upper column, line 14 | upper column, line 18 to page 39, left upper column, line 3 | to page 67, line 13 |
| Constitution of Photographic Layers | Page 156, from left upper column, line 15 to right lower column, line 14 | Page 28, right upper column, lines 1 to 15 | Page 45, lines 41 to 52 |
| Dyes | From page 156, right lower column, line 15 to page 184, right lower column, last line | Page 38, from left upper column, line 12 to right upper column, line 7 | Page 66, lines 18 to 22 |
| Color Mixing Preventing Agents | From page 185, left upper column, line 1 to page 188, right lower column, line 3 | Page 36, right lower column, lines 8 to 11 | From page 64, line 57 to page 65, line 1 |
| Gradation Adjusting Agents | Page 188, right lower column, lines 4 to 8 | — | — |
| Stain Inhibitors | From page 188, right lower column, line 9 to page 193, right lower column, line 10 | Page 37, from left upper column, last line to right lower column, line 13 | From page 65, line 32 to page 66, line 17 |
| Surfactants | From page 201, left lower column, line 1 to page 210, right upper column, last one | From page 18, right upper column, line 1 to page 24, right lower column, last line; and page 27, from left lower column, line 10 from below to right lower column, line 9 | — |
| Fluorine-containing Compounds (as antistatic agents, coating aids, lubricants, and anti-blocking agents) | From page 210, left lower column, line 1 to page 222, left lower column, line 5 | From page 25, left upper column, line 1 to page 27, right lower column, line 9 | — |
| Binders (hydrophilic colloids) | From page 222, left lower column, line 6 to page 225, left upper column, last line | Page 38, right upper column, lines 8 to 18 | Page 66, lines 23 to 28 |
| Tackifiers | From page 225, right upper column, line 1 to page 227, right upper column, line 2 | — | — |
| Antistatic Agents | From page 227, right upper column, line 3 to page 230, left upper column, line 1 | — | — |
| Polymer Latexes | From page 230, left upper column, line 2 to page 239, last line | — | — |
| Mat Agents | Page 240, from left upper column, line 1 to right upper column, last line | | |
| Photographic Processing Methods (Processing steps and additives) | From page 3, right upper column, line 7 to page 10, right upper column, line 5 | From page 39, left upper column, line 4 to page 42, left upper column, last line | From page 67, line 14 to page 69, line 28 |

The citations regarding JP-A-62-215272 take into account the specification, as amended, by the Amendment filed on Mar. 16, 1987.

Of the above-mentioned color couplers, so-called short-wave type yellow couplers as described in JP-A 63-231451, 63-123047, 63-241547, 1-173499, 1-213648 and 1-250944 are also preferably used as yellow couplers.

As cyan couplers for use in the present invention, also preferred are diphenylimidazole cyan couplers as described in JP-A 2-33144, as well as 3-hydroxypyridine cyan couplers described in EP-0,333,185A2 ( especially preferably, 2-equivalent coupler formed from the illustrated 4-equivalent coupler (42) by introducing chlorine split-off groups thereinto, as well as the illustrated couplers (6) and (9)), and cyclic active methylene cyan couplers as described in JP-A 64-32260 (especially preferably, the illustrated couplers Nos. 3, 8 and 34).

For processing the photographic material of the present invention containing high silver chloride emulsion(s) each having a silver chloride content of 90 mol % or more, the process as described in JP-A 2-207250, from page 27, left top column to page 34, right top column is preferably employed.

Next, the present invention will be explained in more detail by way of the following examples, which, however, are not intended to restrict the scope of the present invention.

EXAMPLE 1

Preparation of Emulsion #1:

32 g of a lime-processed gelatin were added to 800 cc of distilled water and dissolved therein at 40° C., and 5.8 g of sodium chloride and 1.9 cc of N,N'-dimethylimidazolidine-2-thione (aqueous 1% solution) were added thereto. The temperature of the reaction system was elevated to 74° C. Subsequently, a solution of 100 g of silver nitrate as dissolved in 400 cc of distilled water and a solution of 27.5 g of sodium chloride and 14.0 g of potassium bromide, as dissolved in 400 cc of distilled water, were added to and blended with the previous solution over a period of 60 minutes with the temperature being kept at 74° C. Next, a solution of 60 g of silver nitrate, as dissolved in 200 cc of distilled water, and a solution of 16.5 g of sodium chloride, 8.4 g of potassium bromide and 4 mg of potassium hexacyanoferrate(II) trihydrate, as dissolved in 200 cc of distilled water, were added and blended therewith over a period of 20 minutes with the temperature still being kept at 74° C. After the reaction system was desalted and washed with water at 40° C., 90 g of a lime-processed gelatin were added thereto, and the pAg value and pH value were adjusted to 7.4 and 6.4, respectively, by adding sodium chloride and sodium hydroxide thereto. After it was heated up to 58° C., $1\times10^{-5}$ mol, per mol of silver halide, of triethylthiourea were added thereto for effecting optimum sulfur sensitization of it. A blue-sensitizing dye (which will be mentioned below) was added thereto in an amount of $3\times10^{-4}$ mol per mol of silver halide, for color sensitization. The silver chlorobromide emulsion thus obtained is called emulsion #1.

Preparation of Emulsion #2:

Emulsion #2 was prepared in the same manner as in the preparation of emulsion #1, except that compound (I-16) of the present invention was added thereto in an amount of $3\times10^{-4}$ mol per mol of silver halide, after the optimum sulfur sensitization.

Preparation of Emulsion #3:

Emulsion #3 was prepared in the same manner as in preparation of emulsion #1, except that tellurium sensitization with $1\times10^{-5}$ mol, per mol of silver halide, of tellurium sensitizing agent (IV-10) of the present invention was applied to the emulsion under the same condition, in place of the sulfur sensitization with triethylthiourea.

Preparation of Emulsion #4:

Emulsion #4 was prepared in the same manner as in preparation of emulsion #3, except that compound (I-16) of the present invention was added thereto in an amount of $3\times10^{-4}$ mol per mol of silver, after the optimum tellurium sensitization.

Preparation of Emulsion #5:

32 g of a lime-processed gelatin were added to 800 cc of distilled water and dissolved therein at 40° C., and 5.8 g of sodium chloride and 1.9 cc of N,N'-dimethylimidazolidine-2-thione (aqueous 1% solution) were added thereto. The temperature of the reaction system was elevated to 74° C. Subsequently, a solution of 100 g of silver nitrate as dissolved in 400 cc of distilled water and a solution of 32.7 g of sodium chloride and 3.5 g of potassium bromide as dissolved in 400 cc of distilled water were added to and blended with the previous solution over a period of 60 minutes with the temperature being kept at 74° C. Next, a solution of 60 g of silver nitrate, as dissolved in 200 cc of distilled water, and a solution of 19.6 g of sodium chloride, 2.1 g of potassium bromide and 4 mg of potassium hexacyanoferrate(II) trihydrate, as dissolved in 200 cc of distilled water, were added to and blended therewith over a period of 20 minutes with the temperature being still kept at 74° C. After the reaction system was desalted and washed with water at 40° C., 90 g of a lime-processed gelatin was added thereto, and the pAg value and pH value thereof were adjusted to 7.4 and 6.4, respectively, by adding sodium chloride and sodium hydroxide thereto. After this was heated up to 58° C., $1\times10^{-5}$ mol, per mol of silver halide, of triethylthiourea were added thereto for optimum sulfur sensitization. In addition, a blue-sensitizing dye, which will be mentioned below, was added thereto in an amount of $3\times10^{-4}$ mol, per mol of silver, for color sensitization. The silver chlorobromide emulsion thus obtained is called emulsion #5.

Preparation of Emulsion #6:

Emulsion #6 was prepared in the same manner as in preparation of emulsion #5, except that compound (I-16) of the present invention was added thereto in an amount of $3\times10^{-4}$ mol, per mol of silver halide, after the optimum sulfur sensitization.

Preparation of Emulsion #7:

Emulsion #7 was prepared in the same manner as in preparation of emulsion #5, except that tellurium sensitization with $1\times10^{-5}$ mol, per mol of silver halide, of tellurium sensitizing agent (IV-10) of the present invention was applied to the emulsion under the same condition, in place of the sulfur sensitization with triethylthiourea.

Preparation of Emulsion #8:

Emulsion #8 was prepared in the same manner as in preparation of emulsion #7, except that compound (I-16) of the present invention was added thereto in an amount of $3\times10^{-4}$ mol per mol of silver, after the optimum tellurium sensitization.

Preparation of Emulsion #9:

32 g of a lime-processed gelatin were added to 800 cc of distilled water and dissolved at 40° C. therein, and 5.8 g of sodium chloride and 1.9 cc of N,N'-dimethylimidazolidine-2-thione (aqueous 1% solution) were added thereto and the temperature of the reaction system was elevated to 74° C. Subsequently, a solution of 100 g of silver nitrate, as dissolved in 400 cc of distilled water, and a solution of 34.4 g of sodium chloride, as dissolved in 400 cc of distilled water, were added to and blended with the previous solution over a period of 60 minutes with the temperature being kept at 74° C. Next, a solution of 60 g of silver nitrate, as dissolved in 200 cc of distilled water, and a solution of 20.6 g of sodium chloride and 4 mg of potassium hexacyanoferrate(II) trihydrate, as dissolved in 200 cc of distilled water, were added to and blended therewith over a period of 20 minutes with the temperature being maintained at 74° C. After the reaction system was desalted and washed with water at 40° C., 90 g of a lime-processed gelatin were added thereto, and the pAg value and pH value thereof were adjusted to 7.4 and 6.4, respectively, by adding sodium chloride and sodium hydroxide thereto. After this was heated to 58° C. to prepare unripened silver chloride emulsion, an emulsion of ultra-fine silver bromide grains (having a grain size of 0.05 μm) were added thereto in such an amount that the silver chlorobromide emulsion grains to be finally formed might have a silver bromide content of 0.5 mol %, and then $1\times10^{-5}$ mol, per mol of silver halide, of triethylthiourea was added thereto for optimum sulfur sensitization. In addition, a blue-sensitizing dye (which will be mentioned below) was added thereto in an amount of $3\times10^{-4}$ mol, per mol of silver, for color sensitization. The silver chlorobromide emulsion thus obtained is called emulsion #9.

Preparation of Emulsion #10:

Emulsion #10 was prepared in the same manner as in preparation of emulsion #9, except that compound (I-16) of the present invention was added thereto in an amount of $3\times10^{-4}$ mol, per mol of silver halide, after the optimum sulfur sensitization.

Preparation of Emulsion #11:

Emulsion #11 was prepared in the same manner as in preparation of emulsion #9, except that compound (I-10) of the present invention was added thereto in an amount of $3\times10^{-4}$ mol, per mol of silver halide, after the optimum sulfur sensitization.

Preparation of Emulsion #12:

Emulsion #12 was prepared in the same manner as in preparation of emulsion #9, except that tellurium sensitization with $1\times10^{-5}$ mol, per mol of silver halide, of tellurium sensitizing agent (IV-10) of the present invention was applied to the emulsion under the same condition, in place of the sulfur sensitization with triethylthiourea.

Preparation of Emulsion #13:

Emulsion #13 was prepared in the same manner as in preparation of emulsion #12, except that compound (I-16) of the present invention was added thereto in an amount of $3\times10^{-4}$ mol per mol of silver, after the optimum tellurium sensitization.

Preparation of Emulsion #14:

Emulsion #14 was prepared in the same manner as in preparation of emulsion #12, except that compound (I-10) of the present invention was added thereto in an amount of $3\times10^{-4}$ mol per mol of silver, after the optimum tellurium sensitization.

The grain shape, grain size and grain size distribution of each of 14 kinds of emulsions #1 to #14 thus prepared were obtained from the respective microscopic photographs. The grain size was represented by a mean value of the diameter of a circle equivalent to the projected area of the grain; and the grain size distribution was represented by a value obtained by dividing the standard deviation of the grain size by the mean grain size.

14 kinds of emulsions #1 to #14 each comprised cubic grains having a sharp corner, a grain size of 0.8 μm and a grain size distribution of 0.08.

Preparation of Emulsions #15 to #28:

Emulsions #15 to #28 were prepared in the same manner as in preparation of emulsions #1 to #14, respectively, except that the grain forming temperature was lowered so that the grain size might be 0.6 μm and the grain size distribution might be 0.09, and a blue-sensitizing dye (which will be mentioned below) was added thereto in an amount of $4\times10^{-4}$ mol, per mol of silver, for color sensitization.

Emulsions #15 to #28 thus prepared and the previously prepared emulsions #9 to #14 each were subjected to X-ray diffraction to give a weak diffraction peak in the area corresponding to a silver bromide content of from 10 mol % to 40 mol %. Therefore, it is concluded that emulsions #9 to #14 and emulsions #15 to #28 each comprise cubic silver chloride grains having a local phase having a silver bromide content of from 10 mol % to 40 mol % as grown on the corners of the grains by epitaxial growth.

Formation of Photographic Materials:

A paper support having both surfaces laminated with polyethylene was subjected to corona discharging treatment, and a gelatin subbing layer containing sodium dodecylbenzenesulfonate was provided thereon. Next, plural photographic constitutive layers each having the composition mentioned below were coated thereover to form a multilayer color photographic material (sample No. 1). Coating liquids were prepared in the manner mentioned below.

Preparation of Coating Liquid for First Layer:

To 19.1 g of yellow coupler (ExY), 4.4 g of color image stabilizer (Cpd-1) and 1.4 g of color image stabilizer (Cpd-7) were added 27.2 cc of ethyl acetate, 4.2 g of solvent (Solv-3) and 4.2 g of solvent (Solv-7), and the former were dissolved in the latter. The resulting solution was added to 185 cc of an aqueous 10 % gelatin solution containing 8 cc of sodium dodecylbenzenesulfonate and then emulsified and dispersed with an ultrasonic homogenizer. The resulting dispersion was blended with the previously prepared silver chlorobromide emulsions #1 and #15 to prepare a coating liquid for the first layer.

Other coating liquids for the second to seventh layers were also prepared in the same manner as in preparation of the coating liquid for the first layer.

As a gelatin hardening agent for each layer, added thereto was 1-hydroxy-3,5-dichloro-s-triazine sodium salt. To each layer were added Cpd-10 and Cpd-11 in a total amount of 25.0 mg/m$^2$ and 50.0 mg/m$^2$, respectively.

The following color sensitizing dyes were added to the silver chlorobromide emulsions of the respective light-sensitive emulsion layers.

Sensitizing Dye for Blue-sensitive Emulsion Layer:

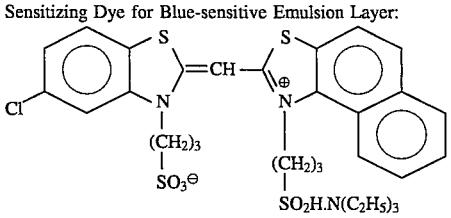

Sensitizing Dye for Green-sensitive Emulsion Layer:

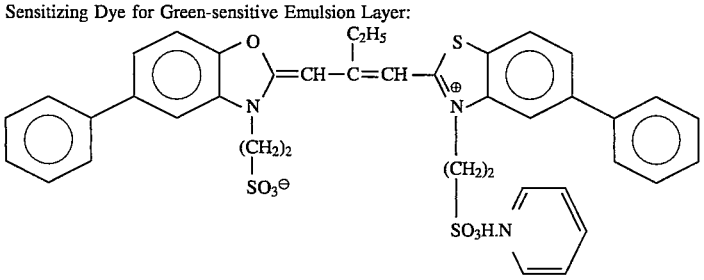

($5\times10^{-4}$ mol/mol of Ag to large-size emulsion and $6\times10^{-4}$ mol/mol of Ag to small-size emulsion)

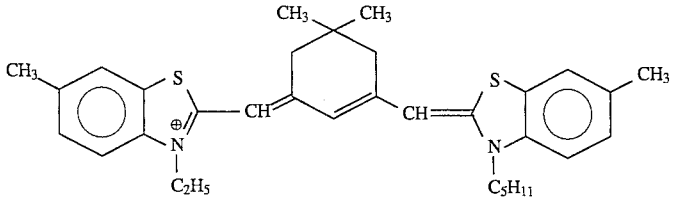

$I^{\ominus}$ ($4.6\times10^{-5}$ mol/mol of Ag to large-size emulsion and $5.6\times10^{-5}$ mol/mol of Ag to small-size emulsion)

To the red-sensitive emulsion layer was added the following compound in an amount of $2.6\times10^{-3}$ mol per mol of silver halide.

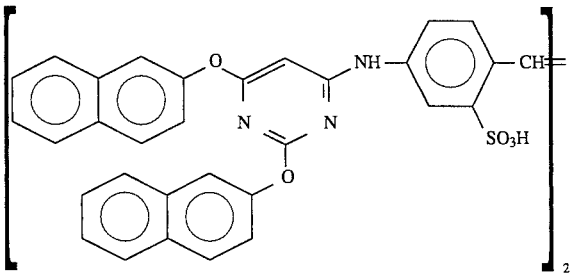

For anti-irradiation, the following dyes were added to the respective emulsion layers, the coated amount being parenthesized.

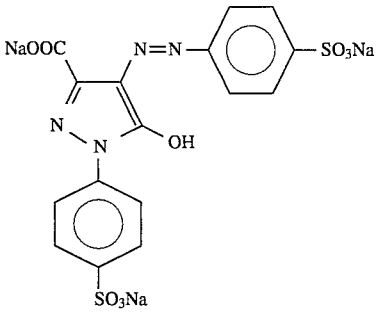

(10 mg/m²)

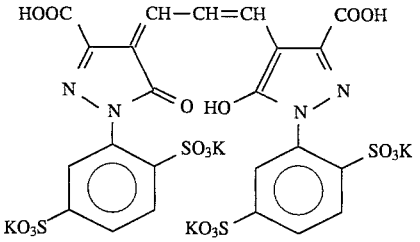

(10 mg/m²)

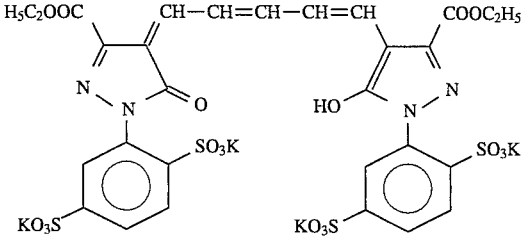

(40 mg/m²)

and

-continued

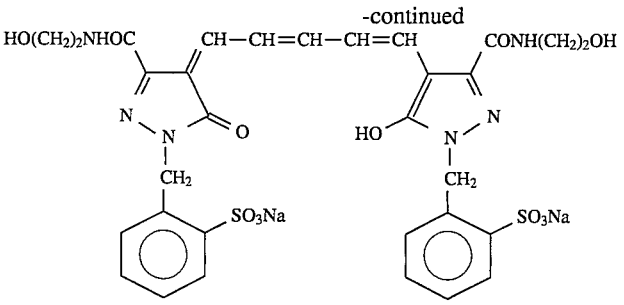

(20 mg/m$^2$)

Layer Constitution:

Compositions of the layers constituting sample No. 101 are mentioned below, in which the numerical value indicates the amount coated (g/m$^2$) and the amount of the silver halide coated is represented as silver therein.

| | |
|---|---|
| Support: | |
| Polyethylene-laminated Paper (containing white pigment ($TiO_2$) and bluish dye (ultramarine) in polyethylene below the first layer) | |
| First Layer: Blue-sensitive Yellow-coloring Layer | |
| Emulsion #1 | 0.15 |
| Emulsion #15 | 0.15 |
| Gelatin | 1.22 |
| Yellow Coupler (ExY) | 0.82 |
| Color Image Stabilizer (Cpd-1) | 0.19 |
| Solvent (Solv-3) | 0.18 |
| Solvent (Solv-7) | 0.18 |
| Color Image Stabilizer (Cpd-7) | 0.06 |
| Second Layer: Color Mixing Preventing Layer | |
| Gelatin | 0.64 |
| Color Mixing Preventing Agent (Cpd-5) | 0.10 |
| Solvent (Solv-1) | 0.16 |
| Solvent (Solv-4) | 0.08 |
| Third Layer: Green-sensitive magenta-coloring Layer | |
| Silver Chlorobromide Emulsion (⅓ mixture (by mol of Ag) of large-size emulsion of cubic grains with a mean grain size of 0.55 μm and small-size emulsion of cubic grains with a mean grain size of 0.39 μm; the two emulsions each had a fluctuation coefficient of the grain size distribution of 0.10 and 0.08, respectively; they contained 0.8 mol % of AgBr locally on a part of the grain surface) | 0.12 |
| Gelatin | 1.28 |
| Magenta Coupler (ExM) | 0.23 |
| Color Image Stabilizer (Cpd-2) | 0.03 |
| Color Image Stabilizer (Cpd-3) | 0.16 |

-continued

| | |
|---|---|
| Color Image Stabilizer (Cpd-4) | 0.02 |
| Color Image Stabilizer (Cpd-9) | 0.02 |
| Solvent (Solv-2) | 0.40 |
| Fourth Layer: Ultraviolet Absorbing Layer | |
| Gelatin | 1.41 |
| Ultraviolet Absorbent (UV-1) | 0.47 |
| Color Mixing Preventing Agent (Cpd-5) | 0.05 |
| Solvent (Solv-5) | 0.24 |
| Fifth Layer: Red-sensitive Cyan-coloring Layer | |
| Silver Chlorobromide Emulsion (¼ mixture (by mol of Ag) of large-size emulsion of cubic grains with a mean grain size of 0.55 μm and small-size emulsion of cubic grains with a mean grain size of 0.45 μm; the two emulsions each had a fluctuation coefficient of the grain size distribution of 0.09 and 0.11, respectively; they contained 0.6 mol % of AgBr locally on a part of the grain surface) | 0.23 |
| Gelatin | 1.04 |
| Cyan Coupler (ExC) | 0.32 |
| Color Image Stabilizer (Cpd-2) | 0.03 |
| Color Image Stabilizer (Cpd-4) | 0.02 |
| Color Image Stabilizer (Cpd-6) | 0.18 |
| Color Image Stabilizer (Cpd-7) | 0.40 |
| Color Image Stabilizer (Cpd-8) | 0.05 |
| Solvent (Solv-6) | 0.14 |
| Sixth Layer: Ultraviolet Absorbing Layer | |
| Gelatin | 0.48 |
| Ultraviolet Absorbent (UV-1) | 0.16 |
| Color Mixing Preventing Agent (Cpd-5) | 0.02 |
| Solvent (Solv-5) | 0.08 |
| Seventh Layer: Protective Layer | |
| Gelatin | 1.10 |
| Acryl-modified Copolymer of Polyvinyl Alcohol (modification degree 17%) | 0.17 |
| Liquid Paraffin | 0.03 |

Compounds used above are mentioned below.

(ExY) Yellow Coupler:
1/1 (by mol) mixture of:

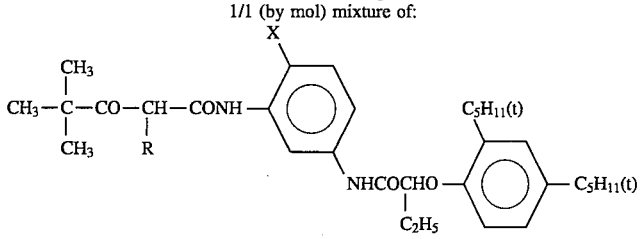

-continued
R = 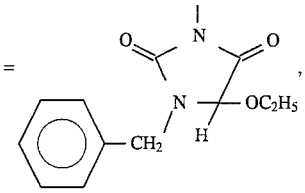 , X = Cl and R = 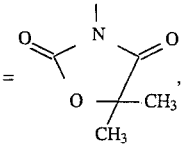 , X = $OCH_3$
(ExM) Magenta Coupler:
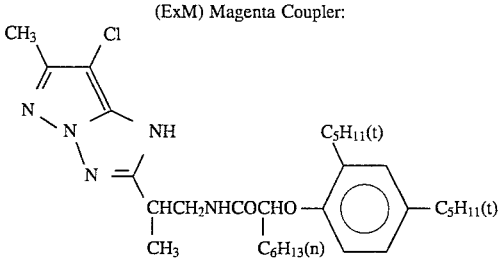
(ExC) Cyan Coupler:
1/1 (by mol) mixture of:
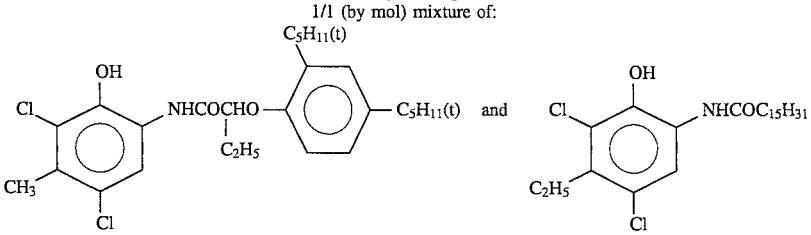
(Cpd-1) Color Image Stabilizer:
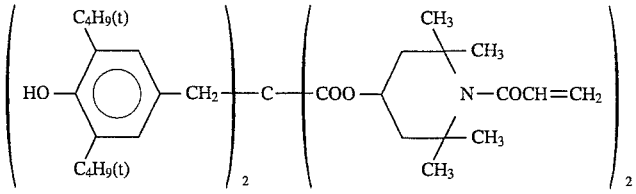
(Cpd-2) Color Image Stabilizer:
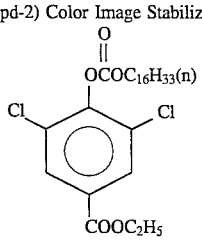
(Cpd-3) Color Image Stablizer:
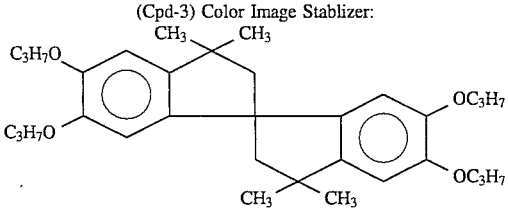
(Cpd-4) Color Image Stabilizer:
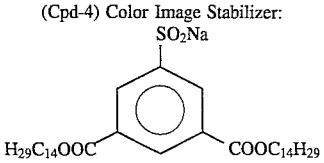
(Cpd-5) Color Mixing Preventing Agent:
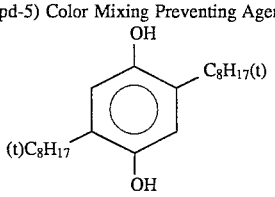
(Cpd-6) Color Image Stabilizer:
2/4/4 (by weight) mixture of:
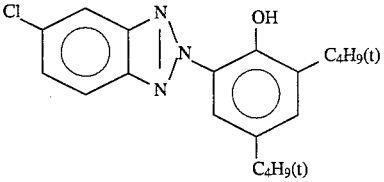
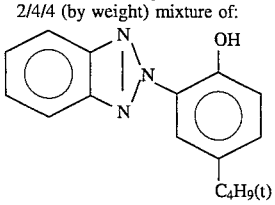
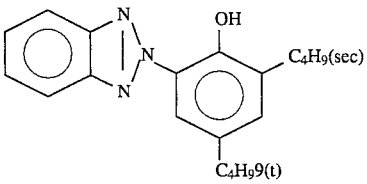
(Cpd-7) Color Image Stabilizer:
(Cpd-8) Color Image Stabilizer:
1/1 (by weight) mixture of:

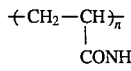
(mean molecular weight: 60,000)
-continued
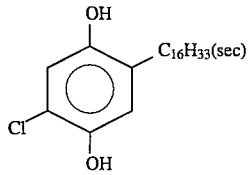
and
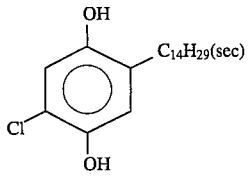
(Cpd-9) Color Image Stabilizer:
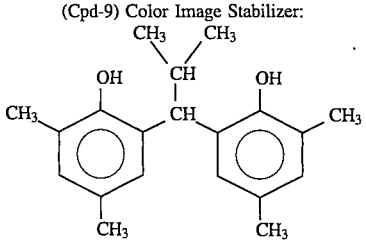
(Cpd-10) Antiseptic:
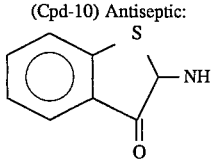
(Cpd-11) Antiseptic:
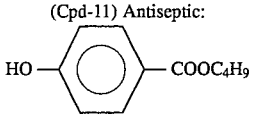
(UV-1) Ultra Absorbent:
4/2/4 (by weight) mixture of:
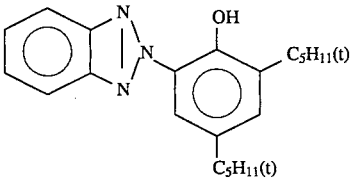
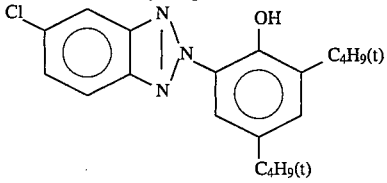
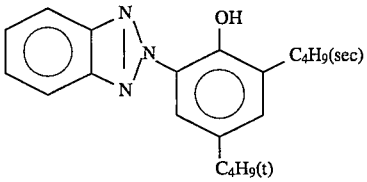
(Solv-1) Solvent:
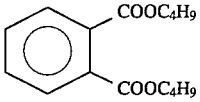
(Solv-2) Solvent:
1/1 (by volume) mixture of:
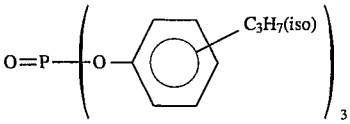
and
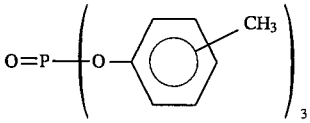
(Solv-3) Solvent:
$O{=}P{-}(O{-}C_9H_{19}(iso))_3$
(Solv-4) Solvent:
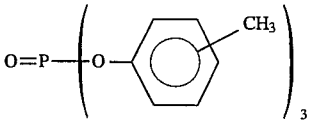
(Solv-5) Solvent:
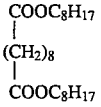
(Solv-6) Solvent:
80/20 (by volume) mixture of:
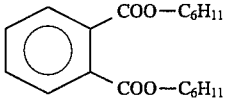
and
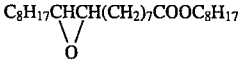
(Solv-7) Solvent:
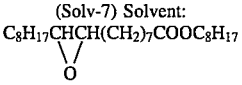

Other photographic material sample Nos. 2 to 14 were prepared in the same manner as in preparation of sample No. 1 (basic sample), except that the emulsions constituting the blue-sensitive layer were varied as shown in Table 1 below.

In addition, still other photographic material sample Nos. 15 to 28 were prepared in the same manner as in preparation of sample Nos. 1 to 14, respectively, except that a colored layer mentioned below is provided between the first layer and the support. These samples are also shown in Table 1.

| Composition of Colored Layer ($g/m^2$): | |
|---|---|
| Gelatin | 0.80 |
| Black Colloidal Silver | 0.20 |
| (Cpd-12) | 0.002 |

(Cpd-12):

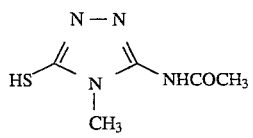

developer reached two times of the tank capacity of the developer tank.

| Processing Step | Temperature (°C.) | Time (sec) | Amount of Replenisher (ml) (*) | Tank Capacity (liters) |
|---|---|---|---|---|
| | Process: | | | |
| Color Development | 35 | 45 | 161 | 17 |
| Bleach-fixation | 30 to 35 | 45 | 215 | 17 |
| Rinsing (1) | 30 to 35 | 20 | — | 10 |
| Rinsing (2) | 30 to 35 | 20 | — | 10 |
| Rinsing (3) | 30 to 35 | 20 | 350 | 10 |
| Drying | 70 to 80 | 60 | | |

(*) Replenishment per $m^2$ of sample being processed.

Rinsing was effected by three-tank countercurrent system from rinsing tank (3) to rinsing tank (1).

TABLE 1

| Sample No. | Emulsions in blue-sensitive Layer (by mol) | Halogen Composition AgBr | Halogen Composition Cl | Local Layer | Chemical Sensitization Method | Compound of the Invention | Colored Layer | Remarks |
|---|---|---|---|---|---|---|---|---|
| 1 | #1 and #15 (1/1) | 0.2 | 0.8 | No | S | — | No | comparative sample |
| 2 | #2 and #16 (1/1) | 0.2 | 0.8 | No | S | I-16 | No | comparative sample |
| 3 | #3 and #17 (1/1) | 0.2 | 0.8 | No | Te | — | No | comparative sample |
| 4 | #4 and #18 (1/1) | 0.2 | 0.8 | No | Te | I-16 | No | comparative sample |
| 5 | #5 and #19 (1/1) | 0.05 | 0.95 | No | S | — | No | comparative sample |
| 6 | #6 and #20 (1/1) | 0.05 | 0.95 | No | S | I-16 | No | comparative sample |
| 7 | #7 and #21 (1/1) | 0.05 | 0.95 | No | Te | — | No | comparative sample |
| 8 | #8 and #22 (1/1) | 0.05 | 0.95 | No | Te | I-16 | No | sample of the invention |
| 9 | #9 and #23 (1/1) | 0.005 | 0.995 | Yes | S | — | No | comparative sample |
| 10 | #10 and #24 (1/1) | 0.005 | 0.995 | Yes | S | I-16 | No | comparative sample |
| 11 | #11 and #25 (1/1) | 0.005 | 0.995 | Yes | S | I-10 | No | comparative sample |
| 12 | #12 and #26 (1/1) | 0.005 | 0.995 | Yes | Te | — | No | comparative sample |
| 13 | #13 and #27 (1/1) | 0.005 | 0.995 | Yes | Te | I-16 | No | sample of the invention |
| 14 | #14 and #28 (1/1) | 0.005 | 0.995 | Yes | Te | I-10 | No | sample of the invention |
| 15 | #1 and #15 (1/1) | 0.2 | 0.8 | No | S | — | Yes | comparative sample |
| 16 | #2 and #16 (1/1) | 0.2 | 0.8 | No | S | I-16 | Yes | comparative sample |
| 17 | #3 and #17 (1/1) | 0.2 | 0.8 | No | Te | — | Yes | comparative sample |
| 18 | #4 and #18 (1/1) | 0.2 | 0.8 | No | Te | I-16 | Yes | comparative sample |
| 19 | #5 and #19 (1/1) | 0.05 | 0.95 | No | S | — | Yes | comparative sample |
| 20 | #6 and #20 (1/1) | 0.05 | 0.95 | No | S | I-16 | Yes | comparative sample |
| 21 | #7 and #21 (1/1) | 0.05 | 0.95 | No | Te | — | Yes | comparative sample |
| 22 | #8 and #22 (1/1) | 0.05 | 0.95 | No | Te | I-16 | Yes | sample of the invention |
| 23 | #9 and #23 (1/1) | 0.005 | 0.995 | Yes | S | — | Yes | comparative sample |
| 24 | #10 and #24 (1/1) | 0.005 | 0.995 | Yes | S | I-16 | Yes | comparative sample |
| 25 | #11 and #25 (1/1) | 0.005 | 0.995 | Yes | S | I-10 | Yes | comparative sample |
| 26 | #12 and #26 (1/1) | 0.005 | 0.995 | Yes | Te | — | Yes | comparative sample |
| 27 | #13 and #27 (1/1) | 0.005 | 0.995 | Yes | Te | I-16 | Yes | sample of the invention |
| 28 | #14 and #28 (1/1) | 0.005 | 0.995 | Yes | Te | I-10 | Yes | sample of the invention |

First, sample No. 10 was subjected to gray exposure in such a way that the developed silver amount thereof might be 30 % of the total silver amount coated, then this was subjected to continuous processing in accordance with the process mentioned below, using the processing solutions also mentioned below, until the replenishment to the color Compositions of the processing solutions used above are mentioned below.

| | Tank Solution | Replenisher |
|---|---|---|
| Color Developer | | |
| Water | 800 ml | 800 ml |
| Ethylenediamine-N,N,N',N'-tetramethylenephosphonic Acid | 1.5 g | 2.0 g |
| Potassium Bromide | 0.015 g | — |
| Triethanolamine | 8.0 g | 12.0 g |
| Sodium Chloride | 1.4 g | — |
| Potassium Carbonate | 25 g | 25 g |
| N-ethyl-N-(β-methanesulfonamidoethyl)-3-methyl-4-aminoaniline Sulfate | 5.0 g | 7.0 g |
| N,N-bis(carboxymethyl)hydrazine | 4.0 g | 5.0 g |
| N,N-di(sulfoethyl)hydroxylamine Monosodium Salt | 4.0 g | 5.0 g |
| Brightening Agent (WHITEX 4B, produced by Sumitomo Chemical Co.) | 1.0 g | 2.0 g |
| Water to make | 1000 ml | 1000 ml |
| pH (25° C.) | 10.05 | 10.45 |
| Bleach-Fixing Solution (tank solution and replenisher were same) | | |
| Water | 400 ml | |
| Ammonium Thiosulfate (700 g/liter) | 100 ml | |
| Sodium Sulfite | 17 g | |
| Ammonium Ethylenediaminetetraacetato/Iron (III) | 55 g | |
| Disodium Ethylenediaminetetraacetate | 5 g | |
| Ammonium Bromide | 40 g | |
| Water to make | 1000 ml | |
| pH (25° C.) | 6.0 | |

Rinsing Solution (tank solution and replenisher were same):

Ion-exchanged Water (having calcium and magnesium content of each being 3 ppm or less).

In order to examine the photographic properties of the above-mentioned 28 kinds of photographic material samples before and after continuous processing of them, each of the samples were exposed for 1/10 second through an optical wedge and a blue filter and then color-developed with the fresh processing solutions not used in the continuous processing and the fatigued processing solutions as used in the continuous processing.

Next, in order to examine the exposure humidity dependence of the photographic material samples, each sample was allowed to stand under the condition of 25° C. and 55% RH and the condition of 25° C. and 85% RH each for 2 hours, then exposed for 1/10 second through an optical wedge and a blue filter, and thereafter color-developed with the fatigued processing solutions as used in the continuous processing.

The reflection density of each of the thus processed samples was measured to obtain a characteristic curve.

The sensitivity is determined by the reciprocal of the exposure amount necessary for giving a higher density than the fog density by 0.5 and is represented by a relative value based on the sensitivity of sample No. 10, sample No. 10 being 100, as exposed for 1/10 second and processed with the fresh processing solutions not used in the continuous processing.

The exposure humidity dependence is represented by the difference between the sensitivity of each sample as stored under the condition of 25° C. and 55% RH and that of the same as stored under the condition of 25° C. and 85% RH, as a logE scale.

For determining the sharpness of each sample, a square wave pattern for CTF measurement was firmly attached to the surface of each sample and the sample was exposed as it was. Subsequently, the sample was color-developed with the fatigued processing solution provided after the continuous processing. The density of the thus processed sample was measured with a microdensitometer. The sharpness is represented by the space frequency number to give a CTF value of being 50 %.

The results obtained are shown in Table 2 below.

TABLE 2

| Sample No. | Sensitivity: before continuous processing (fresh processing solutions) | Sensitivity: after continuous processing (fatigued processing solutions) | Exposure Humidity Dependence (*1) | Sharpness (*2) Space Frequency (number of lines/cm) for 50 % CTF value | Remarks |
|---|---|---|---|---|---|
| 1 | 20 | 15 | −0.10 | 8 | comparative sample |
| 2 | 15 | 10 | −0.05 | 9 | comparative sample |
| 3 | 21 | 18 | −0.20 | 8 | comparative sample |
| 4 | 16 | 14 | −0.16 | 9 | comparative sample |
| 5 | 80 | 56 | −0.08 | 9 | comparative sample |
| 6 | 61 | 43 | −0.03 | 8 | comparative sample |
| 7 | 101 | 97 | −0.15 | 8 | comparative sample |
| 8 | 92 | 90 | −0.02 | 9 | sample of the invention |
| 9 | 125 | 100 | −0.10 | 9 | comparative sample |
| 10 | 100 | 90 | −0.08 | 9 | comparative sample |
| 11 | 100 | 91 | −0.07 | 9 | comparative sample |
| 12 | 136 | 133 | −0.15 | 8 | comparative sample |
| 13 | 111 | 110 | −0.03 | 9 | sample of the invention |
| 14 | 112 | 111 | −0.03 | 9 | sample of the invention |
| 15 | 16 | 12 | −0.10 | 14 | comparative sample |
| 16 | 12 | 8 | −0.06 | 14 | comparative sample |
| 17 | 17 | 14 | −0.20 | 14 | comparative sample |
| 18 | 13 | 11 | −0.15 | 15 | comparative sample |
| 19 | 66 | 43 | −0.08 | 14 | comparative sample |

TABLE 2-continued

| Sample No. | Sensitivity: before continuous processing (fresh processing solutions) | Sensitivity: after continuous processing (fatigued processing solutions) | Exposure Humidity Dependence (*1) | Sharpness (*2) Space Frequency (number of lines/cm) for 50 % CTF value | Remarks |
|---|---|---|---|---|---|
| 20 | 48 | 40 | −0.03 | 15 | comparative sample |
| 21 | 81 | 77 | −0.15 | 15 | comparative sample |
| 22 | 75 | 73 | −0.02 | 15 | sample of the invention |
| 23 | 101 | 85 | −0.09 | 14 | comparative sample |
| 24 | 83 | 72 | −0.08 | 15 | comparative sample |
| 25 | 82 | 71 | −0.08 | 15 | comparative sample |
| 26 | 109 | 106 | −0.14 | 15 | comparative sample |
| 27 | 89 | 87 | −0.02 | 15 | sample of the invention |
| 28 | 90 | 89 | −0.03 | 15 | sample of the invention |

*1 As the value of exposure humidity dependence is near to zero, the dependency is more improved.
*2 Larger the value of sharpness, more the sharpness is improved.

From the results of Table 2, the effect of the present invention is clear.

Precisely, the samples having silver chlorobromide emulsions each having a high silver bromide content had a low sensitivity to be impractical, even in the case as processed with the processing solution before being processed under continuous processing (samples Nos. 1 to 4). Generally, samples having a silver chloride content of 90 mol % or more were suitable to rapid processing. However, samples having such high silver chloride emulsions as sensitized with ordinary sulfur sensitization involved large sensitivity fluctuation before and after continuous processing (samples Nos. 5 and 6). The drawback was overcome by application of tellurium sensitization to the samples but the exposure humidity dependence of the samples worsened (sample No. 7). By combination of compound (I-16) of the present invention and tellurium sensitization, photographic material samples having excellent continuous processing processability and little exposure humidity dependence could be obtained (sample No. 8).

Photographic material samples of the present invention each with a constitution having high silver chloride emulsions with a local silver bromide phase were more preferred, as having a higher sensitivity in addition to the above-mentioned advantages (samples Nos. 13 and 14).

As is clear from the above-mentioned results, since the photographic material of the present invention has satisfactory continuous processability and exposure humidity independence and has a high sensitivity, it may still have a sufficient sensitivity even when a colored layer is provided therein (samples Nos. 22, 27 and 28).

As has been explained in detail in the above, there is provided in accordance with the present invention a silver halide photographic material having excellent rapid processability and a high sensitivity. The material involves little photographic fluctuation before and after continuous processing thereof and little photographic fluctuation due to variation of the ambient humidity during exposure thereof. Further, the image sharpness of the material may be noticeably improved without an appreciable detraction from the sensitivity thereof.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a reflective support having provided thereon a light-sensitive emulsion layer containing a silver halide emulsion wherein said silver halide emulsion contains silver chloride grains or silver chlorobromide grains having a silver chloride content of 90 mol % or more, wherein said grains are tellurium-sensitized with a tellurium sensitizing agent, and wherein said light-sensitive emulsion layer or a non-light-sensitive emulsion layer on the reflective support contain at least one compound represented by formula (I), (II) or (III):

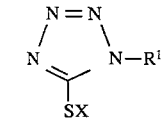
(I)

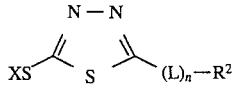
(II)

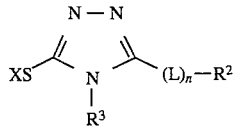
(III)

in formula (I), $R^1$ represents an alkyl group, an alkenyl group or an aryl group; and X represents a hydrogen atom, an alkali metal, an ammonium group or a precursor which is a group capable of yielding a hydrogen or an alkali metal under an alkaline condition;

in formula (II), L represents a divalent linking group; $R^2$ represents a hydrogen atom, an alkyl group, an alkenyl group or an aryl group; X has the same meaning as that in formula (I); and n represents 0 or 1; and in formula (III), X has the same meaning as that in formula (I); L, $R^2$ and n each has the same meaning as in formula (II); $R^3$ has the same meaning as $R^2$ and may be the same or different from $R^2$, wherein an anti-halation layer is provided between the reflective support and the light-sensitive emulsion layer, wherein the anti-halation layer comprises a light-absorbing agent which is fixed to said anti-halation layer before photographic processing, wherein the light-absorbing agent is a colloidal silver or a solid dispersion dye which is substantially water-insoluble at a pH of 6 or less and substantially water-soluble at a pH of 8 or more.

2. The silver halide photographic material as claimed in claim 1, in which the silver halide grains of silver chloride or silver chlorobromide having a silver chloride content of 90 mol % or more each have a local silver bromide phase having a silver bromide content of 10 mol % or more.

3. The silver halide photographic material as claimed in claim 1, in which the tellurium sensitization is effected with at least one tellurium sensitizing agent selected from the group consisting of colloidal tellurium, tellurohydrazides, telluroesters, phosphine tellurides, negative-charged telluride ion-containing gelatins, potassium telluride, and telluropentathionate sodium salt.

4. The silver halide photographic material as claimed in claim 2, in which the tellurium sensitization is effected with at least one tellurium sensitizing agent selected from the group consisting of colloidal tellurium, tellurohydrazides, telluroesters, phosphine tellurides, negative-charged telluride ion-containing gelatins, potassium telluride, and telluropentathionate sodium salt.

5. The silver halide photographic material as claimed in claim 1, in which the tellurium sensitizing agent is a compound represented by general formula (IV):

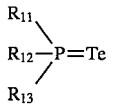

(IV)

where $R_{11}$, $R_{12}$ and $R_{13}$ independently represent an aliphatic group, an aromatic group, a heterocyclic group, $OR_{14}$, $NR_{15}(R_{16})$, $SR_{17}$, $OSiR_{18}(R_{19})(R_{20})$, a halogen atom or a hydrogen atom, or $R_{11}$ and $R_{12}$ may be bonded together to form a ring with the phosphorus atom, $R_{11}$ and $R_{13}$ may be bonded together to form a ring with the phosphorus atom, and $R_{12}$ and $R_{13}$ may be bonded together to form a ring with the phosphorus atom;

$R_{14}$ and $R_{17}$ independently represent an aliphatic group, an aromatic group, a heterocyclic group, a hydrogen atom or a cation;

$R_{15}$ and $R_{16}$ independently represent an aliphatic group, an aromatic group, a heterocyclic group or a hydrogen atom, or are bonded together to form a nitrogen-containing hetero ring;

$R_{18}$, $R_{19}$ and $R_{20}$ independently represent an aliphatic group.

6. The silver halide photographic material as claimed in claim 4, in which the tellurium sensitizing agent is a compound represented by general formula (IV):

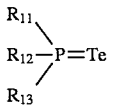

(IV)

where $R_{11}$, $R_{12}$ and $R_{13}$ independently represent an aliphatic group, an aromatic group, a heterocyclic group, $OR_{14}$, $NR_{15}(R_{16})$, $SR^{17}$, $OSiR_{18}(R_{19})(R_{20})$, a halogen atom or a hydrogen atom, or $R_{11}$ and $R_{12}$ may be bonded together to form a ring with the phosphorus atom, $R_{11}$ and $R_{13}$ may be bonded together to form a ring with the phosphorus atom, and $R_{12}$ and $R_{13}$ may be bonded together to form a ring with the phosphorus atom;

$R_{14}$ and $R_{17}$ independently represent an aliphatic group, an aromatic group, a heterocyclic group, a hydrogen atom or a cation;

$R^{15}$ and $R_{16}$ independently represent an aliphatic group, an aromatic group, a heterocyclic group or a hydrogen atom, or are bonded together to form a nitrogen-containing hetero ring;

$R_{18}$, $R_{19}$ and $R_{20}$ independently represent an aliphatic group.

7. The silver halide photographic material as claimed in claim 1, in which the silver halide grains are sensitized with a combination of the tellurium sensitizing agent and a gold sensitizing agent.

8. The silver halide photographic material as claimed in claim 1, in which the compound represented by formulae (I), (II) or (III) is incorporated into a silver halide emulsion after completion of physical ripening but before completion of chemical ripening, or to a coating liquid of the silver halide emulsion.

9. The silver halide photographic material as claimed in claim 1, in which the silver halide grains of silver chloride or silver chlorobromide have a silver chloride content of 95 mol % or more.

10. The silver halide photographic material as claimed in claim 1, in which the silver halide grains of silver chloride or silver chlorobromide have a silver chloride content of 99 mol % or more.

* * * * *